235-381 3R
MTR13 XR 4,463,939

[redacted]United States Patent [19]
Watanabe

[11] Patent Number: 4,463,939
[45] Date of Patent: Aug. 7, 1984

[54] SLIP ISSUING DEVICE

[75] Inventor: Yoshihiro Watanabe, Fujisawa, Japan

[73] Assignee: Tokyo Shibaura Denki Kabushiki Kaisha, Kanagawa, Japan

[21] Appl. No.: 396,371

[22] Filed: Jul. 8, 1982

[30] Foreign Application Priority Data

Jul. 10, 1981 [JP] Japan ..... 56-107695

[51] Int. Cl.³ ..... B41F 13/54
[52] U.S. Cl. ..... 270/1.1; 235/381; 235/379; 400/586
[58] Field of Search ..... 270/1.1; 400/586, 593, 400/605; 235/381, 379, 432, 448; 194/DIG. 6, 479

[56] References Cited

U.S. PATENT DOCUMENTS

| | | | |
|---|---|---|---|
| 3,855,457 | 12/1974 | Amundson | 235/475 X |
| 4,079,826 | 3/1978 | Shaw | 400/593 X |
| 4,166,945 | 9/1979 | Inoyama | 235/381 |
| 4,216,719 | 8/1980 | Flaceliere | 400/605 X |
| 4,266,121 | 5/1981 | Hiruse | 235/381 |
| 4,280,036 | 7/1981 | Fukatsu | 235/379 |
| 4,293,236 | 10/1981 | Shimizu | 400/593 |
| 4,369,360 | 7/1983 | Tsuji | 235/381 X |

FOREIGN PATENT DOCUMENTS

| | | | |
|---|---|---|---|
| 2812482 | 9/1979 | Fed. Rep. of Germany | 400/586 |
| 49-15498 | 2/1974 | Japan | 270/1.1 |
| 53-62391 | 5/1978 | Japan | 270/1.1 |
| 54-36816 | 3/1979 | Japan | 270/1.1 |

*Primary Examiner*—E. H. Eickholt
*Attorney, Agent, or Firm*—Cushman, Darby & Cushman

[57] ABSTRACT

A slip issuing device comprises a guide station, a first separating station, a cutting station, a printing station and a second separating station successibly along a conveying direction for a string of slips. The guide station allows a string of slips to travel along the conveying direction. The first separating station temporarily separates the string of slips into a string of receipts and a string of journals. The cutting station cuts a single receipt for one transaction from the string of receipts. The printing station prints predetermined transaction content on the slip. The second separating station separates the string of slips into the string of receipts and the string of journals when issuing the single receipt and allows the strings of receipts and journals to come together and travel to a take-up station when setting the string of slips.

23 Claims, 21 Drawing Figures

SLIP ISSUING DEVICE

BACKGROUND OF THE INVENTION

The present invention relates to slip issuing device in which slips are composed of a journal sheet and a receipt and, more particularly, to a slip issuing device which provides a receipt as needed on which a transaction content is printed.

In order to automate service at a teller's window and provide further convenience to the customer, automatic bank note transaction apparatuses having an automatic bank note depositting unit or an automatic bank note dispensing unit or both have been widely used. These automatic bank note transaction apparatuses generally all have slip issuing device. A slip issuing device is arranged to notify transaction contents to the customer and to record and file them in a bank. For this device, a string of slips which are folded zigzag-fashion is used. Each slip consists of a journal for the bank at the lower side thereof and a receipt for the customer at the upper side thereof. The journal and the receipt are made of a carbonless duplicating paper.

Predetermined transaction contents are printed on the slip, that is, both journal and receipt by a printer. Further, customer information represented by characters/numerals on an embossed portion of an inserted ID card is also transferred to both the journal and the receipt through a transfer roller. Thereafter, the journal is taken up by a take-up reel of a take-up unit disposed in the slip issuing device. The journal is then kept at the bank for a predetermined period of time. Each receipt for each transaction is cut off from the string of slips and is separated from the corresponding journal. As a result, the customer can receive the receipt.

For setting the string of perforated slips in a conventional slip issuing device, the operator takes out part of the string stored zigzag-fashion in a slip storage box; the part of the string of slips corresponds to only a few transactions. The leading end of the string of journals taken out from the slip storage box is wound around a take-up reel, while the string of receipts corresponding to a small number of transactions is cutout at a perforation between the adjacent receipt. After the presetting operation described above, engaging pins radially extending from both sides of the outer surface of a sprocket are fitted in engaging holes aligned along each side of the slip. Thus, the slip is mounted on the sprocket. Note that reference pins at either side of the sprocket must be fitted in the engaging holes formed at either side of the leading end of the first transaction slip. Thereafter, the string of slips is displaced by slightly rotating a guide plate for separating the journal from the receipt and is passed through a receipt-cutting unit by manual operation. The operator must insert the leading end of the string of slips to detour the transfer roller, further, must realign the journal with the cut receipt and insert them through a narrow gap between a printing head and an anvil of a printer.

This setting operation of the string of slips in the conventional slip issuing device is time-consuming and cumbersome.

SUMMARY OF THE INVENTION

The present invention has been made in consideration of the conventional problem described above and has for its object to provide a slip issuing device for automatically properly setting a string of slips.

According to an aspect of the present invention, there is provided a slip issuing device which has a string of slips separable from each other and each having a receipt and a journal, which records customer information and a transaction content thereon, which stores a string of journals therein, and which provides a single receipt comprising: a housing having a receipt dispensing port through which the receipt is dispensed; storing means disposed in the housing, for storing the string of slips which can be taken out; guiding means engageable with the string of slips taken out from the storing means, for allowing the string of slips to travel along a conveying direction on a first conveying passage; first separating means disposed adjacent to the guiding means along the conveying direction, for temporarily separating the string of slips into the string of receipts and the string of journals; printing means disposed adjacent to the first separating means along the conveying direction, for allowing the strings of receipts and duplicates which are separated by said first separating means to come together and for printing predetermined transaction content thereon; cutting means disposed between the printing means and the first separating means, for cutting the single receipt for one transaction from the string of receipts separated from the string of journals; and second separating means disposed adjacent to the printing means along the conveying direction, for separating the string of slips into the string of receipts to be conveyed in a second conveying passage and the string of journals on a third conveying passage when issuing the single receipt and for allowing the strings of receipts and journal to come together and travel on the third conveying passage when setting the string of slips.

DETAILED DESCRIPTION OF THE PREFERRED EMBODIMENT

One embodiment of a slip issuing device according to the present invention will be described in detail with reference to the accompanying drawings in a case of applying to an automatic bank note transaction apparatus.

Figure 1:
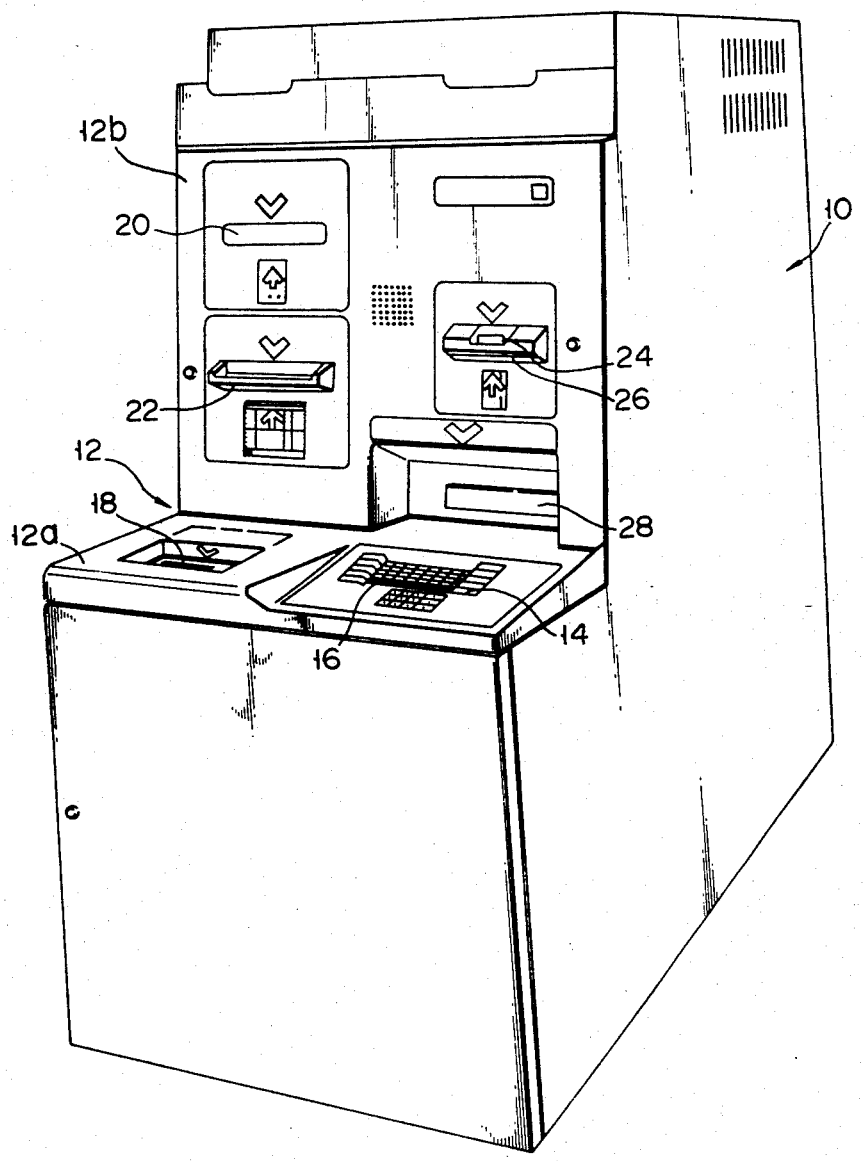
FIG. 1 is a perspective view of an automatic bank note transaction apparatus including one embodiment of a slip issuing device according to the present invention.

Referring to FIG. 1, reference numeral 10 denotes a housing of an automatic bank note transaction apparatus. A customer operation part 12 is disposed at the front of the housing 10. The customer operation part 12 has a horizontal operation panel 12*a* disposed substantially halfway down the front side and a vertical operation panel 12*b* extending upright from the rear edge of the horizontal operation panel 2*a*.

On the horizontal operation panel 12*a* are arranged a keyboard 14 for entering data, a CRT display 16 for displaying input data and instructions for the customer, and an inlet/outlet port 18 which functions as a bank note insertion/dispensing port. An envelope insertion port 20 and a bankbook insertion port 22 are vertically arranged on one side of the vertical operation panel 12*b*. On the other side of the vertical operation panel 12*b* are arranged a magnetic ID card insertion port 24, a receipt dispensing port 26 which is disposed immediately below the magnetic ID card insertion port 24, and a bank note dispensing port 28 which is disposed below the receipt dispensing port 26 and which has a central line at a position deviated from that of the magnetic ID card insertion port 24 and the receipt dispensing port 26 by a predetermined distance.

Figure 2:
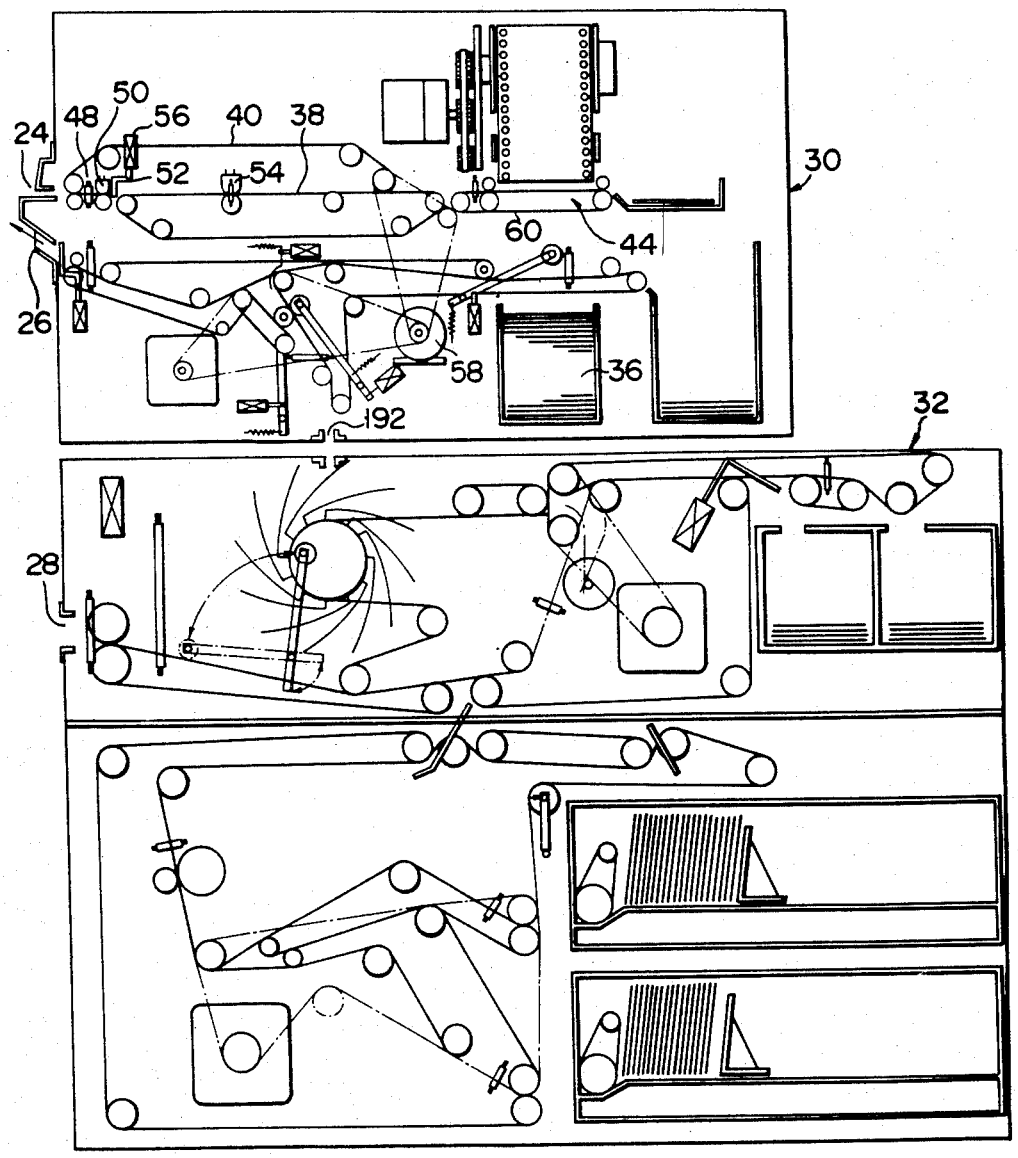
FIG. 2 is a schematic side view showing the internal mechanisms of the apparatus shown in FIG. 1.
Figure 3:
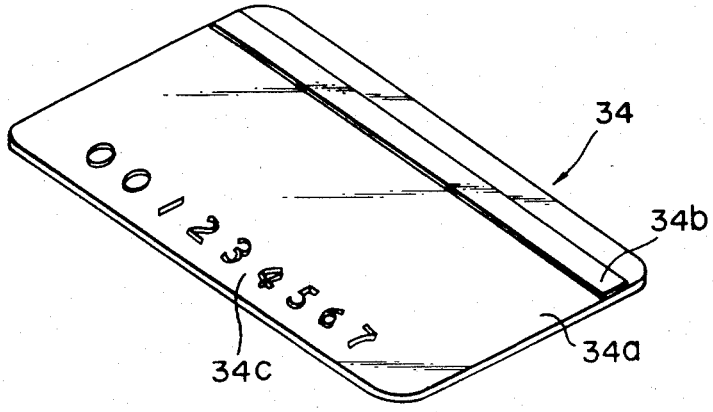
FIG. 3 is a perspective view of an ID card used for the apparatus shown in FIG. 1.

As shown in FIG. 2, a slip issuing device 30 (to be described in detail later) which communicates with the magnetic ID card insertion port 24 and the receipt dispensing port 26 is disposed in the housing 10. A bank note dispensing mechanism 32 which communicates with the bank note dispensing port 28 is also disposed in the housing 10 and under the slip issuing device 30. Further, in the housing 10 are arranged a bankbook reader/recorder (not shown) for reading data on a magnetic stripe of the bankbook inserted through the bankbook insertion port 22 and for recording transaction contents in the bankbook, an envelope processing unit for printing predetermined characters on the envelope inserted through the envelope insertion port 20 and for receiving the envelope therein, a bank note insertion mechanism for receiving the bank notes inserted through the port 18 and so on.

A magnetic ID card 34 inserted through the card insertion port 24 comprises a synthetic resin plate 34*a* of 0.7 mm thickness, a magnetic stripe 34*b* longitudinally extending at one side of the plate 34*a*, and an embossed portion 34*c* longitudinally extending at the other side of the plate 34*a*. The magnetic stripe 34*b* is disposed at a distance of 6 mm from one side edge of the plate 34*a*, and customer information is magnetically recorded thereon. A customer registration number is embossed in the embossed portion 34*c* at a height of 0.4 mm on the surface of the plate 34*a*.

Figure 4:
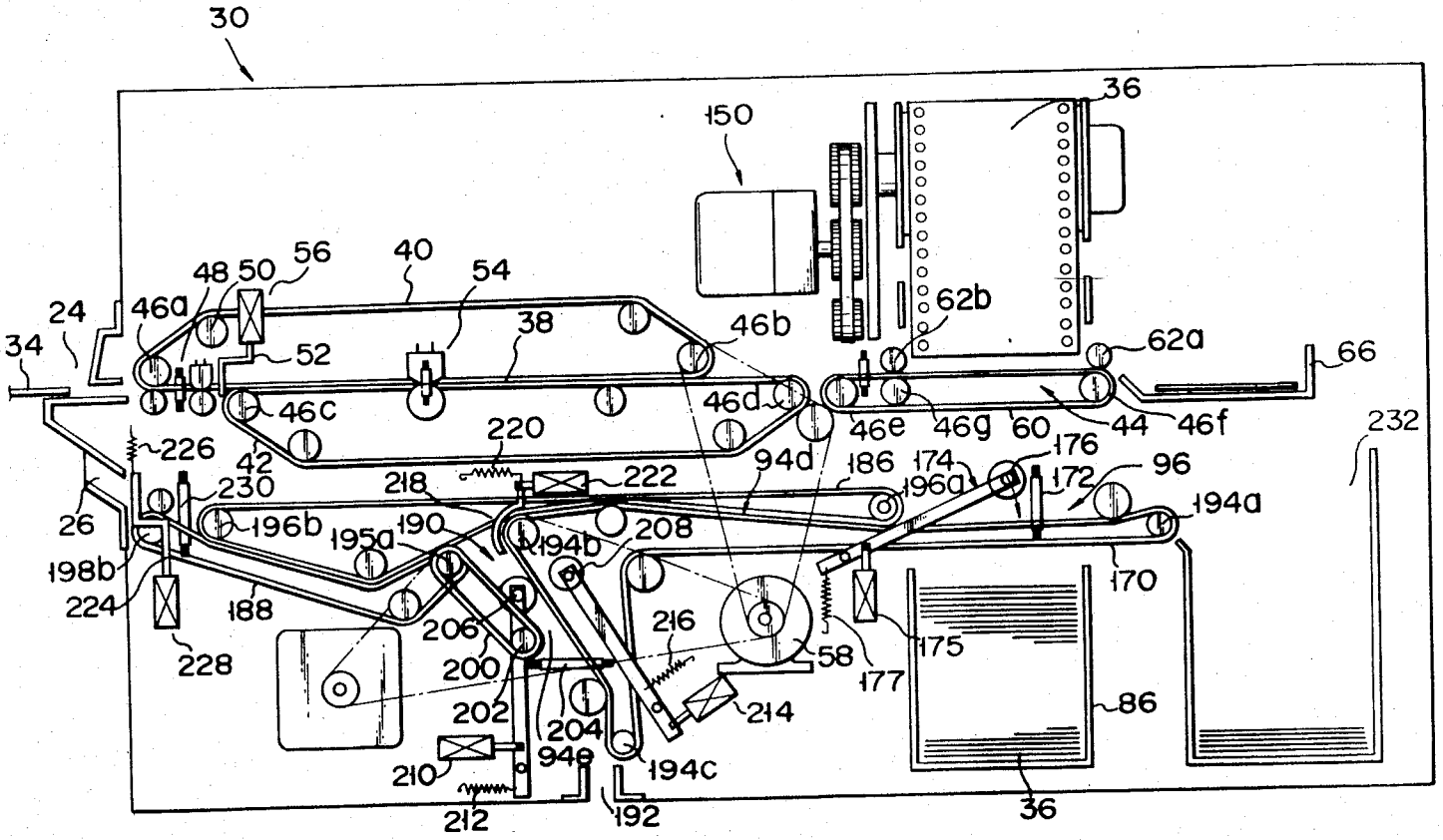
FIG. 4 is a side view of the slip issuing device shown in FIG. 2.

The slip issuing device 30 described above reads out data from customer information recorded on the magnetic stripe 34*b* of the magnetic ID card 34, prints transaction contents and transfers characters/numerals embossed on the embossed portion 34*c* of the magnetic ID card 34 onto two-layered slips 36 composed of two carbonless duplicating papers. One layer of the printed slip 36 corresponding to a receipt 36*a* is conveyed to the receipt dispensing port 26 as needed. As shown in FIG. 4, the slip issuing device 30 includes a magnetic ID card conveying passage 38 one end of which opposes the magnetic ID card insertion port 24 and which substantially horizontally extends therefrom. The conveying passage 38 is defined between the opposing surfaces of a pair of first endless belts 40 and a pair of second endless belts 42 (only one of each pair is illustrated). The other end of the conveying passage 38 opposes an embossing station 44 to be described later. Each first endless belt 40 is looped between a first roller 46*a* disposed immediately behind the magnetic ID card insertion port 24 and a second roller 46*b* disposed immediately above the conveying passage 38. Each second endless belt 42 is looped between a third roller 46*c* disposed adjacent to the embossing station 44 and a fourth roller 46*d* disposed immediately below the conveying passage 38.

Along the conveying passage 38 are arranged a first photocoupler 48 for detecting insertion of the magnetic ID card 34, a first magnetic head 50 for detecting whether or not data exist on the magnetic stripe 34*b* of the magnetic ID card 34, a first shutter 52 for allowing the conveying passage to open, and a second magnetic head 54 for reading out data on the magnetic stripe 34*b* in the order named along a direction indicated by an arrow X. When the first photocoupler 48 is turned on by detecting insertion of the magnetic ID card 34, the first shutter 52 allows the conveying passage 38 to open through a first actuator 56.

A first motor 58 which is reversibly driven in one (forward) or opposite direction is connected to the second and fourth rollers 46*b* and 46*d*. The pairs of first and second endless belts 40 and 42 is run to travel the magnetic ID card 34 in the direction indicated by X or in the direction opposite to that indicated X opposite direction by the reversible first motor 58. If predetermined data is not recorded on the magnetic stripe 34*b* of the magnetic ID card 34 or if a card with no magnetic stripe is inserted, the first magnetic head 50 cannot detect data from the magnetic ID card. In this case, the conveying operation of the first motor 58 in one or forward direction is interrupted, so that the card is stopped at a position slightly inside the first shutter 52. Thereafter, the first motor 58 is driven in the opposite direction, so that the card is driven in the direction opposite to that indicated by X. Upon reverse travelling of the card, the magnetic stripe 34*b* of the magnetic ID card 34 crosses the first magnetic head 50 again. The first magnetic head 50 then checks again whether or not data is present on the card.

Conveying of the magnetic ID card 34 in the opposite direction continues until the first photocoupler 48 is turned off. If no data can be detected from the magnetic ID card 34 by the first magnetic head 50, the first motor 58 is further driven in the opposite direction. The magnetic ID card 34 is then removed from the housing 10 through the magnetic ID card insertion port 24, and the first shutter 52 is closed. However, if the first magnetic head 50 detects data from the magnetic ID card 34 before the first photocoupler 48 is turned off, the driving of the first motor 58 is temporarily interrupted, and the first motor 58 is driven in the original direction. As a result, the magnetic ID card 34 is conveyed into the housing 10 again along the direction indicated by X.

Note that the magnetic ID card 34 can be removed by immediately closing the first shutter 52 to reject further insertion of the magnetic ID card 34 in the housing 10 or by driving the first motor 58 in the opposite direction to that indicated by X when the first magnetic head 50 cannot detect proper data from the magnetic ID card 34. However, if the above operation is performed, a reception efficiency of the magnetic ID card 34 is adversely lowered. Since insertion of the magnetic ID card is performed by the customer, for example, the customer inserts the magnetic ID card 34 at an irregular speed or in a skewed manner. In order to eliminate the trouble described above, the magnetic ID card 34 is scanned twice in the one embodiment of the slip issuing device according to the present invention. Even if the first magnetic head 50 cannot initially detect data from the magnetic ID card, a second reading is performed when the magnetic ID card 34 is clamped between the pairs of first and second endless belts 40 and 42 and is conveyed by a constant speed back to the magnetic ID card insertion port 24, thus greatly increasing the reception efficiency of the magnetic ID card. As a result, a highly reliable automatic bank note transaction apparatus can be obtained.

Meanwhile, when the first magnetic head 50 detects data from the magnetic stripe **34*b*, the magnetic ID card 34 is conveyed in the conveying passage 38 along the direction indicated by X, upon rotation of the first motor 58 in one or forward direction. The second magnetic head 54 reads out the stored contents of the magnetic stripe 34*b*. Thereafter, the magnetic ID card 34 is fed to the embossing station 44 along the conveying passage 38**.

The embossing station 44 has a third endless belt. The third endless belt 60 is looped between a fifth roller **46*e* which is located at one end of the embossing station 44 and which opposes the fourth roller 46*d* of the conveying passage 38, and a sixth roller 46*f* which is located at the other end of the embossing station 44. The upper end of the third endless belt 60 is disposed to support the bottom surface at the one side edge of the magnetic ID card 34. A seventh roller 46*g* is rotatably disposed between the fifth and sixth rollers 46*e* and 46*f* to support the trailing end of the magnetic ID card 34 when the leading end of the magnetic ID card 34 is placed on the sixth roller 46*f*. First and second pinch rollers 62*a* and 62*b* clamp the third endless belt 60 against the sixth and seventh rollers 46*f* and 46*g***, respectively.

The fifth roller **46*e* is driven by the first motor 58 in one or opposite direction, so that the magnetic ID card 34 placed on the conveyor belt 60 is driven in the direction indicated by X or in the direction opposite to that indicated by X. When the magnetic ID card 34 reaches the conveyer belt 60, the leading end at one side edge of the magnetic ID card 34 is firmly clamped by the sixth roller 46*f* and the first pinch roller 62*a*, while the trailing end thereof is firmly clamped by the seventh roller 46*g* and the second pinch roller 62*b*. In this condition, a bed 64 is positioned to support the magnetic ID card 34 from its embossed portion 34*c*** to the opposite side edge of the card.

A tray 66 is disposed near the endless belt 60 along the direction indicated by X. The tray 66 temporarily safeguards the magnetic ID card 34 which is not taken by the customer even though it is dispensed at the magnetic ID card dispensing port 24. That is, the magnetic ID card 34 dispensed at the port 24 is fed back to the embossing station 44 through the conveying passage 38 after a predetermined period of time has elapsed, further, the endless belt 60 is driven in the direction indicated by X to store the magnetic ID card 34 in the tray 66.

Figure 6:
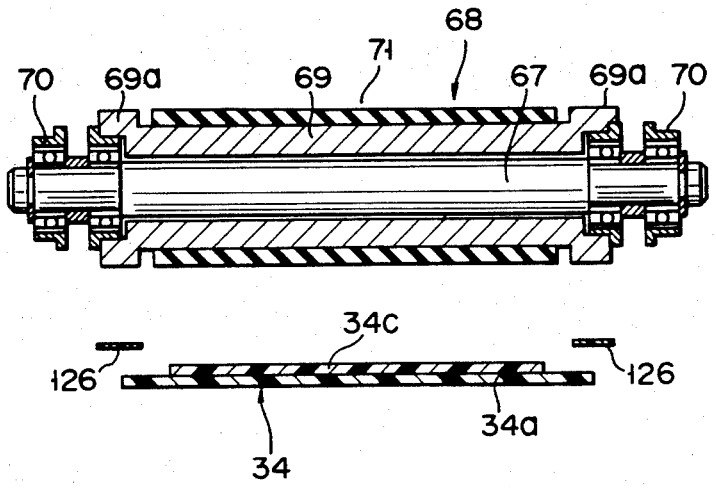
FIG. 6 is a side sectional view of a transfer roller under which the ID card is placed.
Figure 5:
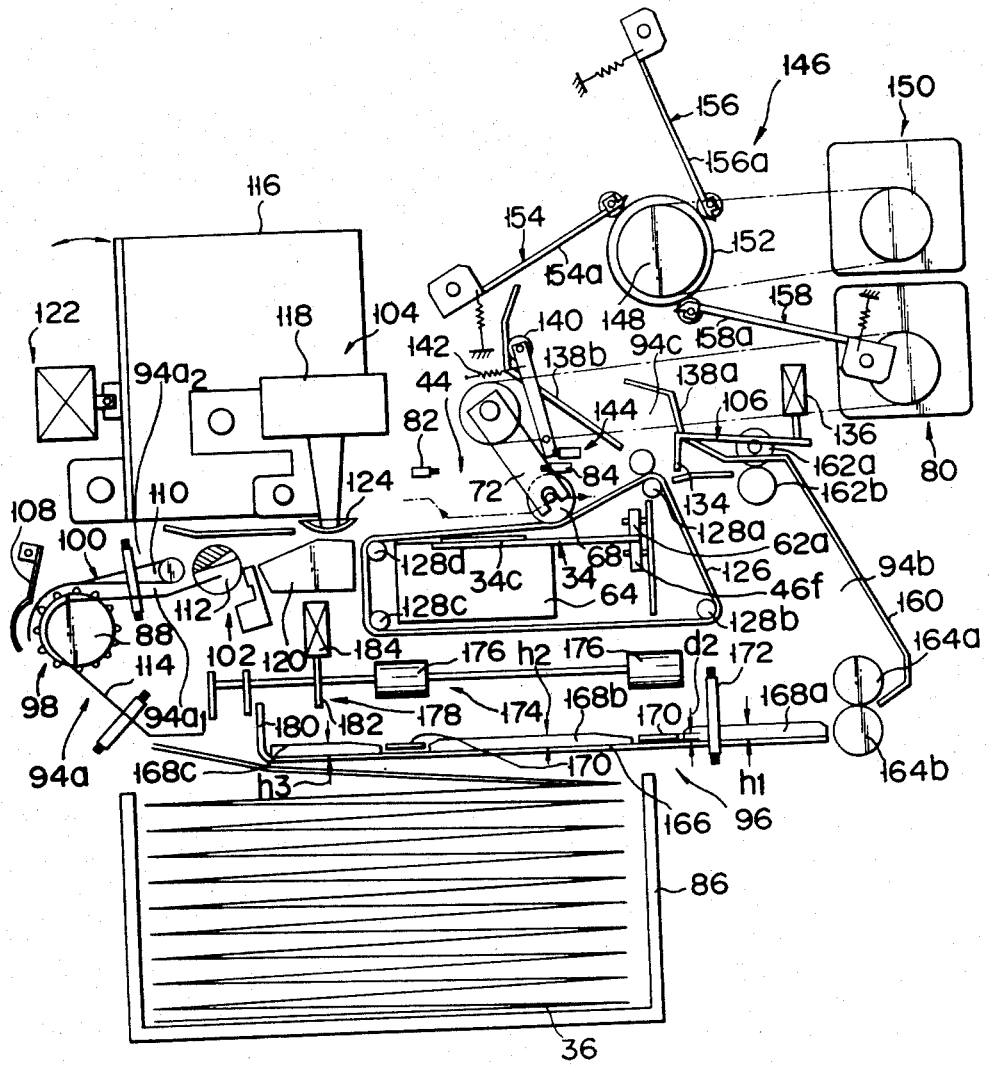
FIG. 5 is a front view of the slip issuing device.

As shown in FIG. 5, a transfer roller 68 is disposed in the embossing station 44 for transferring to the slips 36 (to be described later) information patterned in the embossed portion **34*c* of the magnetic ID card 34 which is placed on the bed 64. As shown in detail in FIG. 6, the transfer roller 68 has a shaft 67, a support roller 69 which is rotatably mounted around the central part of the shaft 67 to be coaxial therewith, a roller portion 71 which is mounted along the outer circumferential surface of the support roller 69 and which is made of hard rubber, and a pair of engaging rollers 70 which are rotatably mounted at both ends of the shaft 67 to be coaxial therewith. The axial length of the roller portion 71 of the transfer roller 68 is determined to be the same as the longitudinal length of the embossed portion 34*c* of the magnetic ID card 34. A pair of flanges 69*a* which have the outer circumferential surface substantially on the same plane as that of the roller portion 71 are formed at both ends of the support roller 69. Each flange 69*a* is spaced apart from the each end of the roller portion 71 by a predetermined distance. With this distance, deformation of the roller portion 71 due to transfer pressure is axially absorbed, thus preventing any adverse effect of the transfer operation. The transfer roller 68** swings within a plane perpendicular to the direction indicated by X.

A pair of support arms 72 which swingably support the transfer roller 68 are pivotally mounted about a shaft 73 attached to the upper ends thereof on a frame (not shown). A groove 74 with a predetermined depth is respectively formed at the lower end of each support arm 72 along the extending direction of the support arm 72 and opened to the lower end edge thereof. The size of the groove 74 is determined to allow the sliding movement therein of the engaging roller 70 along the extending direction of the support arm 72. In the condition that each engaging roller 70 is fitted in the respective groove 74, a spring 76 is provided to urge the engaging roller 70 upward (in FIG. 9) along each groove 74.

A pair of cam members 78 are fixed above the magnetic ID card 34 placed on the bed 64 and oppose the card 34 to define movement of transfer roller 68. Each cam member 78 has a first cam portion **78*a* which is engageable with the corresponding engaging roller 70 and which is parallel to the embossed portion 34*c* of the magnetic ID card 34. The first cam portion 78*a* causes the transfer roller 68 to move parallel to the embossed portion 34*c* when the engaging rollers 70 are engaged therewith, such that the slip 36 positioned between the engaging rollers 70 and the embossed portion 34*c* tightly contacts the embossed portion 34*c*. Each cam member 78 further has second and third cam portions 78*b* and 78*c* which are inclined upward at both sides of the first cam portion 78, and fourth and fifth cam portions 78*d* and 78*e* which are continuously formed with the second and third cam portions 78*b* and 78*c* and which are parallel to the first cam portion 78*a*. The fourth and fifth cam portions 78*d* and 78*e* are respectively positioned above the first cam portions 78*a*. When the engaging rollers 70 are engaged with the fourth or fifth cam portions 78*d* and 78*e*, respectively, that is, when the waiting state is initiated, the transfer roller 68 is raised above and is spaced apart from the magnetic ID card 34. However, when the engaging rollers 70 are respectively engaged with the first cam portions 78*a*, the transfer roller 68 roll over the embossed portion 34*c* of the magnetic ID card 34 at a constant pressure. With the above arrangement, when the transfer roller 68 is kept in the waiting state, the magnetic ID card 34 conveyed onto the bed 64 may not be jammed by the transfer roller 68 since the transfer roller 68 is kept above the upper surface of the magnetic ID card 34**.

A second motor 80 is connected to the support arms 72 which are then swung. The support arms 72 are swung between a first waiting position where the engaging rollers 70 are engaged with the fourth cam portions 78*d* and a second waiting position where the engaging rollers 70 are engaged with the fifth cam portions 78*e*. A second photocoupler 82 is provided in the first waiting position and is turned on when the support arms 72 are located in the first waiting position. A third photocoupler 84 is provided in the second waiting position and is turned on when the support arms 72 are located in the second waiting position.

Figure 8:
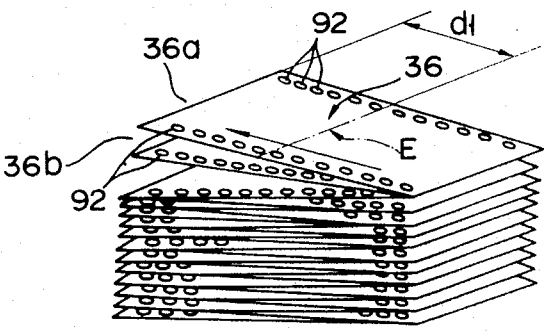
FIG. 8 is a perspective view showing a string of slips which are folded zigzag-fashion and each of which consists of a receipt and a journal.
Figure 7:
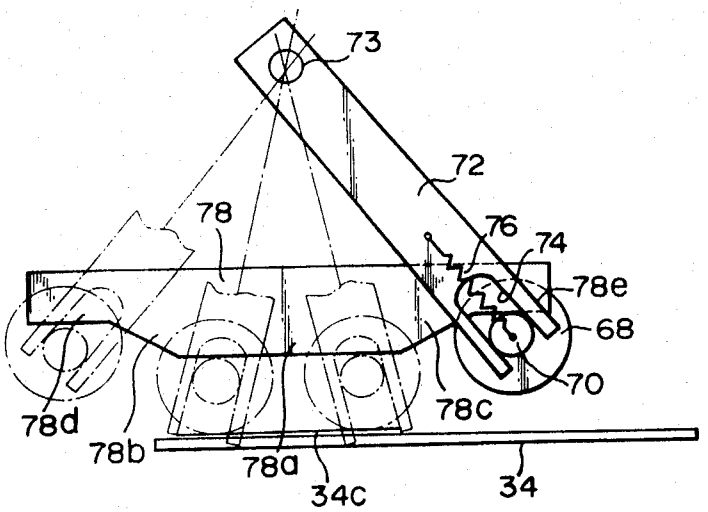
FIG. 7 is a front view showing the transfer operation of the transfer roller.

The slip issuing device 30 has a slip storage box 86 at the lower part of the embossing station 44, as shown in FIGS. 4 and 5. The string of slips 36 is stored in the slip storage box 86 and can be taken out therefrom. The string of slips 36 has the receipt 36*a* to the customer and the journal 36*b* which underlies the receipt 36*a* and which has the same size as the receipt 36*a*, as shown in FIG. 8. The receipt 36*a* and the journal 36*b* are made of carbonless duplicating paper. The slip 36 has a 140 mm length which corresponds to a length for one transaction in this embodiment. A number of slips 36 are connected in a string and are folded zigzag-fashion, as shown in FIG. 8. These slips 36 are housed in the slip storage box 86. Thirteen engaging holes are formed aligned at equal intervals at each side edge of the slips 36 and are set to be able to engage thirteen engaging pins 90 which extend from the periphery of each side of a sprocket 88 at corresponding equal intervals. Note that adjacent slips 36 are detachable from each other by a perforation. A first printing position E of the slip 36 is spaced apart from the leading end thereof by a distance d1. In this embodiment, the distance d1 is determined to be 50 mm from the leading end.

A slip conveying passage 94 is formed between the slip storage box 86 and the receipt dispensing port 26. As shown in FIG. 5, the slip conveying passage 94 is constituted by: a first conveying passage portion 94*a* for conveying the slip 36 from the slip storage box 86 to a second separating station 106 within a vertical plane perpendicular to the direction indicated by X; a second conveying passage portion 94*b* for conveying the receipt 36*a* from the second separating station to a direction converting station 96; a third conveying passage portion 94*c* for conveying the journal 36*b* from the second separating station 106 to a take-up station 146; a fourth conveying passage portion 94*d* for conveying the receipt 36*a* from the direction converting station 96 to the receipt dispensing port 26 within a vertical plane parallel to the direction indicated by X; and a fifth conveying passage portion 94*e* which branches half-way down the fourth conveying passage portion 94*c* to convey the receipt 36*a* to a switch-back station 190.

As shown in FIG. 5, a guide station 98, a first separating station 100, a cutting station 102, a printing station 104, the embossing station and the second separating station 106 are arranged in the first conveying passage portion 94*a* along the conveying direction of the slip 36 in the order named.

Figure 9:
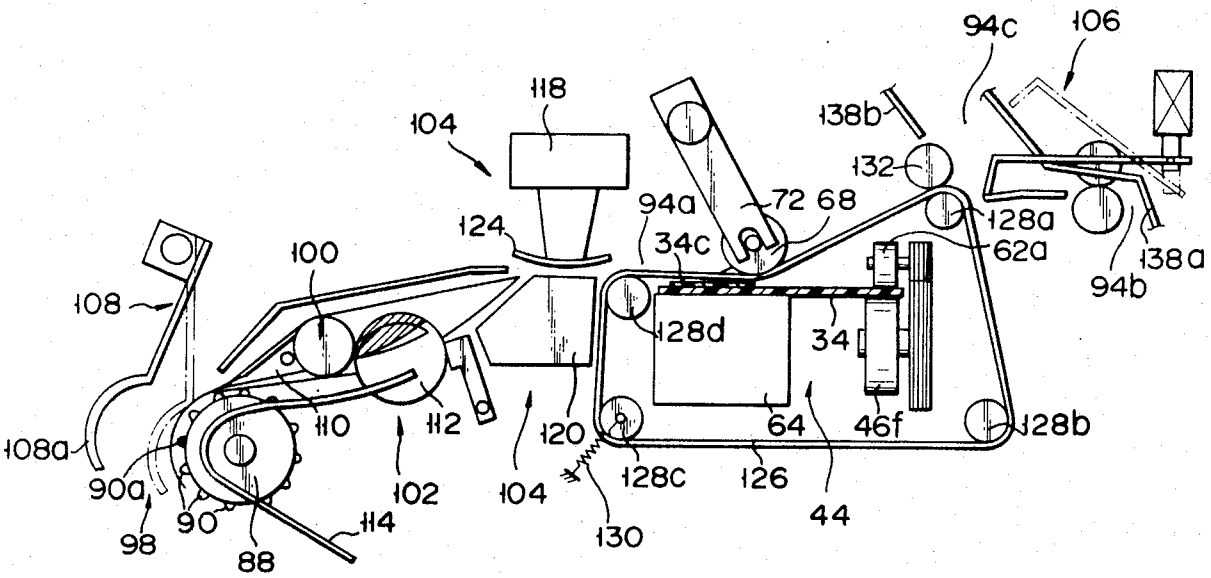
FIG. 9 is a front view of peripheral equipment of a first conveying passage.

The guide station 98 is positioned to the left (in figure) of the embossing station 44 and includes the sprocket 88 which is rotatable, as shown in FIG. 9. The thirteen pins 90 extend on the outer periphery of both sides of the sprocket and fit in the engaging holes 92 aligned along each side of the slip 36 at the same pitch as the pins 90. The slip 36 is conveyed by engagement of the engaging holes 92 with the engaging pins 90 upon rotation of the sprocket 88. The diameter of the sprocket 88 is determined so as to convey one slip for one transaction by one revolution. A first guide 108 is face-contactible on to that part of the outer surface of the sprocket 88 which corresponds to the first conveying passage portion 94*a*. The first guide 108 is rotatably mounted on the frame so that its one end is pivoted. An arcuated portion 108*a* is formed at the other end of the first guide 108 and corresponds to part of the outer surface of the sprocket 88. After the slip 36 is engaged with the sprocket 88, the first guide 108 is rotated to cause the arcuated portion 108*a* to clamp the slip 36 and to urge it onto the outer surface of the sprocket 88. Thus, the slip 36 is properly mounted on the sprocket 88.

One of the thirteen engaging pins 90 is defined as a reference pin 90*a* which has a different color from any other pin. The leading hole in the leading end of the slip 36 in the direction indicated by X is engaged by the reference pin 90*a*. A timing sensor (not shown) which rotates synchronously with rotation of the sprocket 88 is connected thereto to generate a control signal for each revolution of the sprocket 88; that is, every time each slip for each transaction is conveyed. In particular, the timing sensor generates the control signal to cause the cutting station 102 to cut the receipt only at a timing when the slip 36 is being conveyed upon rotation of the sprocket and when the leading end thereof reaches a predetermined cutting position of the cutting station 102. With the timing sensor, each receipt is cut at a boundary (perforation) of the adjacent receipts.

The first separating station 100 is disposed adjacent to the guide station 98 and has a wedge-shaped separating pawl 110 for temporarily separating slip 36 into the receipt 36*a* and the journal 36*b*. The thickness of the separating pawl 110 is gradually increased along the conveying direction toward its proximal end. The distal end of the separating pawl 110 is very thin and flexible, and comes in contact with the outer surface of the sprocket 88.

The cutting station 102 is disposed adjacent to the first separating station 100 and has a so-called rotary cutter 112. The rotary cutter 112 cuts at a perforation the receipt 36*a* (separated from the journal 36*b* by the first separating station) in response to the control signal from the timing sensor. The receipt 36*a* cut at the cutting station 102 overlays the corresponding journal 36*b* prior to the printing station 104, thus the receipt 36*a* and the journal 36*b* constitute the slip 36 again. A second guide 114 is disposed between the guide station 98 and the cutting station 102. The receipt 36*a* separated from the journal 36*b* at the first separating station 100 is passed through the cutting station 102 along the second guide 114.

The printing station 104 is disposed between the cutting station 102 and the embossing station 44, as shown in FIG. 5. The printing station 104 has: a main body 116 pivotally mounted on the frame; a dot printer head 118 which is fixed on the main 116 and which records transaction contents on the reconstituted slip 36; an anvil 120 which is fixed on the frame and which opposes the dot printer head 118; and a solenoid 122 which is connected to the main body 116 and which regulates the pivotal position of the main body 116. The anvil 120 is positioned below the first conveying passage portion 94a, while the dot printer head 118 is located thereabove. When the solenoid 122 is energized, the main body 116 causes the dot printer head 118 to be spaced apart from the anvil 120. However, when the solenoid 122 is de-energized, the main body 116 causes the dot printer head 118 to come close to the anvil 120. A printing position of the printing station 104 is spaced apart from the cutting position of the cutting station 102 by a distance of 35 mm. A press plate 124 formed of an elastic material is mounted at the distal end of the dot printer head 118. When printing is performed, the solenoid 122 is de-energized and the reconstituted slip 36 is pressed on the anvil 120 by the press plate 124, thus achieving stable printing.

Figure 10:
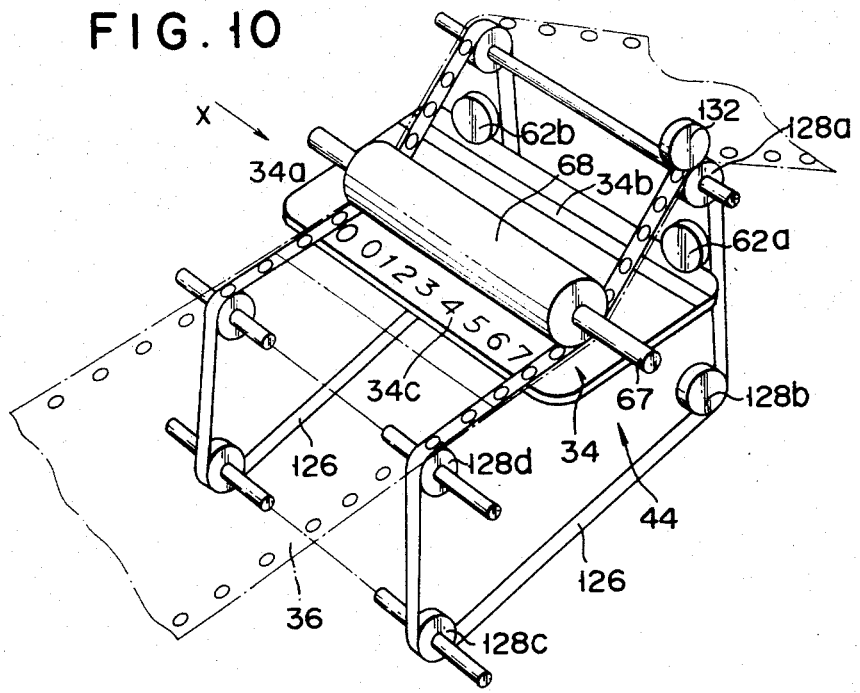
FIG. 10 is a perspective view of a transfer station.

A pair of fourth endless belts 126 are mounted in the embossing station 44 to surround the magnetic ID card 34 conveyed thereto. The upper surface of each one of the pair of fourth endless belts 126 partially defines the first conveying passage portion 94a and is looped around four rollers 128a, 128b, 128c and 128d, as shown in FIG. 10. The first roller 128a is an idler roller and is positioned at the upper right-hand corner in FIG. 9 and above the magnetic ID card 34 placed on the bed 64. The second roller 128b is a drive roller and is positioned at the lower right-hand corner of the figure. The second roller 128b is driven by a motor (not shown). The third roller 128c is a tension roller and is positioned at the lower left-hand corner of the figure. The third roller 128c is urged by the spring 130 to spread each one of the pair of endless belts 126 outwardly. Further, the fourth roller 128d is an idler roller and is positioned to the left of the magnetic ID card 34. The pair of fourth endless belts 126 support the two sides of the magnetic ID card 34 and are spaced apart from each other at a predetermined distance at either end of the embossed portion 34c of the magnetic ID card 34, as shown in FIG. 10. The thickness of each one of the pair of fourth endless belts 126 is thinner than that of the embossed portion 34c of the magnetic ID card 34, whereby the fourth endless belts 126 do not interfere with the transfer operation.

Figure 11:
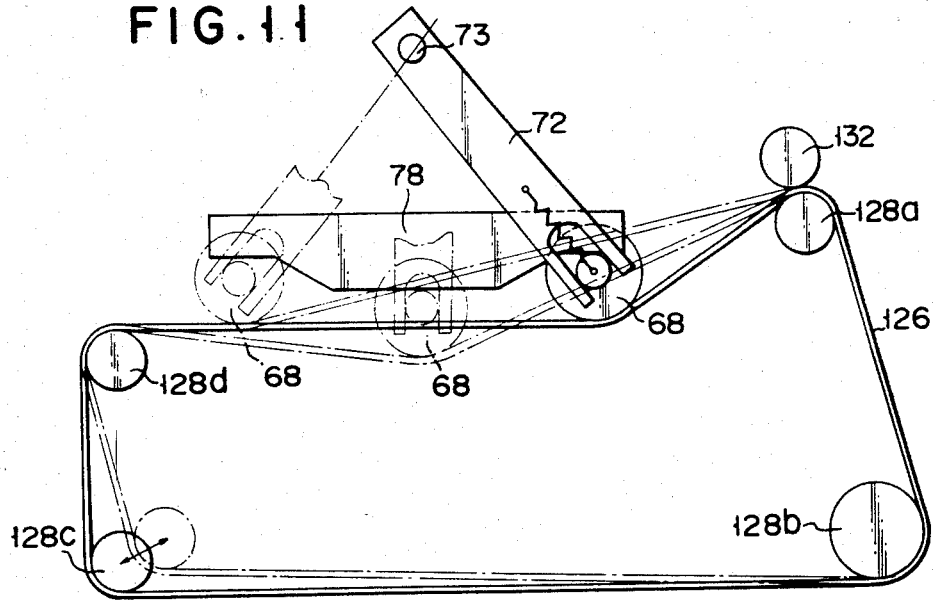
FIG. 11 is a front view showing the operating conditions of a conveyor belt in the transfer station.

Those portions of the upper surfaces of the pair of fourth endless belts 126 which are between the first and fourth rollers 128a and 128d contact the transfer roller 68. Therefore, the magnetic ID card 34 placed in the embossing station 44 is positioned immediately below the upper portions of the pair of fourth endless belts 126. When the transfer roller 68 is pivoted about the shaft 73 from the first waiting position to the second waiting position, the contact state of the pair of fourth endless belts on either side of the magnetic ID cards 34 is changed, as shown in FIG. 11. However, since the third roller 128 is used as the tension roller, the tension of each one of the pair of fourth belts 126 is kept substantially constant even if the contact position of the transfer roller 68 on the magnetic ID card 34 is changed. A pinch roller 132 is disposed above the first roller 128a and to be in contact with the fourth belt 126 around the first roller 128a.

The nip portion between the pinch roller 132 and the first roller 128a is spaced apart from the cutting position of the cutting station 102 by a distance of 135 mm which is 5 mm shorter than the length (140 mm) of one transaction slip. After the slip is cut at a perforation in the cutting station to prepare the receipt 36a for one transaction, the receipt 36a and the journal 36b are clamped together between the pinch roller 132 and the first roller 128a.

As shown in FIG. 9 again, the second separating station 106 is disposed to oppose the nip portion between the first roller 128a and the pinch roller 132. The second separating station 106 has a separating gate 134 which is movable between a connecting position where the separating gate 134 crosses the first conveying passage portion 94a to connect the first conveying passage portion 94a with the third conveying passage portion 94c, and a separating position where the separating gate 134 causes the nip portion to open and separates the first conveying passage portion 94a into the second and third conveying passage portions 94b and 94c. A solenoid 136 is connected to the separating gate 134 to regulate the position thereof. When the solenoid 136 is excited, the separating gate 134 is regulated and positioned in the connecting position, while the separating gate 134 is regulated and positioned in the separating position when the solenoid 136 is de-energized.

The third conveying passage portion 94c extends upward from the first conveying passage portion 94a, starting from the nip portion of the second separating station 106. The third coveying passage portion 94c is defined between a pair of guide walls 138a and 138b which oppose each other. As shown in FIG. 5, a dancer roller 140 which is free to swing is disposed in the third conveying passage portion 94c. The dancer roller 140 is constantly urged by a spring 142 to abut against the left guide wall 138b. A fourth photocoupler 144 is arranged to detect whether or not the dancer roller 140 is positioned in a predetermined pivotal position. The fourth photocoupler 144 is connected to a third motor 150 to be described later.

As shown in FIG. 5, a take-up station 146 is disposed at the distal end of the third conveying passage portion 94c. The take-up station 146 has a take-up reel 148 rotatably mounted on the frame. The third motor 150 is arranged to drive the take-up reel 148 in the clockwise direction. A friction band 152 which has a high coefficient of friction is adhered to cover the entire outer circumferential surface of the take-up reel 148.

Three press members 154, 156 and 158 are disposed around the take-up reel 148 at equal intervals. Each the press member 154, 156 and 158 is pivotally mounted on the frame and the other end thereof has arm 154a, 156a and 158a, one end of which is pivotally mounted on the frame, and the other end of which extends the periphery of the take-up reel 148. Press rollers 154b, 156b and 158b are rotatably mounted at the other ends of the arms 154a, 156a and 158a, respectively. Each the press roller 154b, 156b and 158b is rollable around the outer surface of the friction band 152. The arms 154a, 156a and 158a are urged by springs 154c, 156c and 158c in the clockwise direction, respectively. In other words, the arms 154a, 156a and 158a are urged by these springs to tightly contact the friction band 152.

The second conveying passage portion 94 branched from the second separating station 106 terminates at the direction converting station 96. The second conveying passage portion 94b between the second separating station 106 and the direction converting station 96 is defined by a third guide wall 160. The third guide wall 160 is integral with the guide wall 138a for defining the right side (FIG. 9) of the third conveying passage portion 94c. A drive roller 162a and a pinch roller 162b are disposed at the upstream portion of the third guide wall 160 along the conveying direction to convey the receipt 36a separated at the second separating station 106. An another drive roller 164a and an another pinch roller 164b are disposed at the downstream portion of the third guide wall 160 along the conveying direction to fly the receipt 36a to the direction converting station 96.

While the first printing position of the slip having a receipt next to the cut receipt 36a is positioned in the printing position of the printing station 104, the nip portion between the another drive roller 164a and the another pinch roller 164b is set to clamp the leading end of the cut receipt 36a.

The direction converting station 96 changes the conveying direction of the receipt 36a from the direction perpendicular to the direction indicated by X to the direction indicated by X and conveys the receipt 36a along the second conveying passage portion 94b. In the direction converting station 96 are disposed a table 166 which extends in the conveying direction of the second conveying passage portion 94b, and first to third guide tables 168a, 168b and 168c which are placed on the table 166 and which are sequentially disposed along the conveying direction of the second conveying passsage portion 94b at given intervals. A pair of grooves are formed between the adjacent guide tables 168a and 168b and between the adjacent guide tables 168b and 168c. A pair of fifth endless belts 170 are positioned in the pair of grooves, respectively.

Heights h1, h2 and h3 of the first, second and third guide tables 168a, 168b and 168c are sequentially lowered along the conveying direction in the order named. Further, the thickness corresponding to the minimum height h3 is greater than a thickness d2 of the fifth belts 170. In other words, the heights h1, h2 and h3 and the thickness d2 satisfy the following inequality: $d2<h3<h2<h1$. The position of the nip portion between the another drive roller 164a and the another pinch roller 164b is higher than the upper surface of the first guide 168a, that is, the upper surface thereof. A fifth photocoupler 172 is arranged in the first guide table 168a to detect whether the receipt 36a passes therethrough.

A pressing mechanism 174 is disposed in the direction converting station 96 to depress the receipt 36a on the fifth belts 170. The pressing mechanism 174 has a pair of press rollers 176 which are positioned above the pair of fifth belts 170, respectively. The pair of press rollers 176 are lowered to depress the receipt 36a on the pair of fifth belts 170 through a solenoid 175 (FIG. 4) after the fifth photocoupler 172 is turned off and a predetermined period of time has elapsed. The pressing mechanism 174 is displaced upward by a spring 177 so as not to interfere with the direction converting station 96 to which the receipt 36a is conveyed when the pressing mechanism 174 is inoperative.

A position regulating mechanism 178 is disposed in the direction converting station 96 to regulate the stop position of the receipt 36a. The position regulating mechanism 178 has a stationary stopper 180 disposed at the distal end of the table 166 and a movable stopper 182 disposed in front of the stationary stopper 180 to allow the second conveying passage portion 94b to close. The position of the stationary stopper 180 is defined such that the center of the magnetic ID card 34 dispensed at the magnetic ID card insertion/dispensing port 24 is substantially aligned with the center of the receipt 36a which is conveyed along the fourth conveying passage portions 94d and reaches the receipt dispensing port 26 after the receipt 36a abuts against the stationary stopper 180. A solenoid 184 is connected to the movable stopper 182. When the solenoid 184 is de-energized, the movable stopper 182 is moved upward to open the second conveying passage portion 94b. However, when the solenoid is energized, the movable stopper 192 is moved downward to close the second conveying passage portion 94b. The position of the movable stopper 182 is defined such that the center of the receipt which is conveyed along the fifth conveying passage portion 94e and reaches the bank note dispensing mechanism 32, 36a is substantially aligned with the center of the bank note dispensed at the bank note dispensing port 28 after the receipt 36a abuts against the movable stopper 182. In other words, if the receipt 36a is handed to the customer together with the magnetic ID card 34, the solenoid 184 is de-energized. However, if the receipt 36a is handed to the customer together with the bank note, the solenoid 184 is energized. With the above arrangement, the receipt 36a is positioned at substantially the center of the magnetic ID card 34 or the bank note which is handed to the customer therewith. They are dispensed in a neat manner, thus giving comfort to the customer.

The fourth conveying passage portion 94d is disposed along the card insertion direction X and is perpendicular to the first to third conveying passage portions 94a to 94c. The fourth conveying passage portion 94d is defined between opposing surfaces of the pair of fifth endless belts 170 and a pair of sixth endless belts 186 and between opposing surfaces of the pair of sixth endless belts 186 and a pair of seventh endless belts 188. The switch-back station 190 is disposed substantially halfway down the fourth conveying passage portion 94d. A communicating port 192 is formed at that portion of the bottom plate of the slip issuing device 30 which is positioned below the switch-back station 190 to communicate with the bank note dispensing mechanism 32.

The pair of the fifth endless belts 170 are looped around a roller 194a disposed at the proximal end of the direction converting station 96, a roller 194b disposed at the inlet side of the switch-back station 190, and a roller 194c facing the communicating port 192. The pair of sixth belts 186 are looped between a roller 196a located at the distal end of the direction converting station 96, and a roller 196b opposing the receipt dispensing port 26. The pair of seven endless belts 188 is looped between a roller 198a disposed at the outlet side of the switch-back station 190, and a roller 198b opposing the receipt dispensing port 26.

Since the upper surface of the receipt 36a faces down at the direction converting station 96, the switch-back station 190 is provided for turning the receipt 36a over. The switch-over station 190 has the fifth conveying passage portion 94e branched downward from the fourth conveying passage portion 94d. The fifth conveying passage portion 94e is defined between those portions of the pair of fifth endless belts 170 which are between the rollers 194b and 194c and that portion of a single eighth endless belt 200 which opposes those portions of the fifth endless belts 170 and has a wide width. The eighth endless belt 200 is set to face a space defined between the pair of fifth endless belts 170 and is looped between a roller 202 disposed near the communicating port 192 and the roller 198. A sixth photocoupler 204 is arranged below the fifth conveying passage portion 94e.

A pair of first pinch rollers 206 are provided in the switch-back station 190 so as to be contactible to those portions of the fifth endless belts 170 which are between the pair of rollers 194b and 194c, respectively. The pair of first pinch rollers 206 rotatably contact the pair of fifth endless belts 170 from the left-hand side (FIG. 4), respectively. Similarly, a second pinch roller 208 is disposed between the pair of endless belts 170 and slidably contact eighth endless belt 200 from the right-hand side (FIG. 4). The pair of first pinch rollers 206 are constantly urged by a spring 212 to the right (FIG. 4) to depress the receipt 36a at the switch-back station 190 onto the pair of fifth endless belts 170. For conveying the receipt 36a from the switch-back station 190 to the receipt dispensing port 26, a solenoid 210 is energized to eliminate the first pinch rollers 206 from the fifth conveying passage portion 94e to the left side (FIG. 4). Meanwhile, the second pinch roller 208 is constantly urged by a spring 216 to the right side, so that the second pinch roller is eliminated from the fifth conveying passage portion 94e to the right side. However, for dispensing the receipt 36a from the switch-back station 190 to the receipt dispensing port 26, the second pinch roller 208 is urged to the left and a solenoid 214 is energized to urge the second pinch roller 208 to the left, so that the receipt 36a is depressed onto the eighth belts 200 by the second pinch roller 208.

A gate 218 is disposed at the inlet port of the switch-back station 190 to temporarily bring the receipt 36a conveyed from the direction converting station 96 to the fifth conveying passage portion 94e. The gate 218 is constantly urged by a spring 220 to close the fourth conveying passage portion 94d. The receipt 36a conveyed from the direction converting station 96 is abutted to the gate 218 and is changed the conveying direction of the receipt 36a and conveyed along the fifth conveying passage portion 94e. Meanwhile, the gate 218 is urged by a solenoid 222 to open the fourth conveying passage portion 94d when the receipt 36a is directly fed from the receipt dispensing port 26.

A shutter 224 is arranged at the distal end of the fourth conveying passage portion 94d, that is, on the rear side of the receipt dispensing port 26. The shutter 224 is constantly urged by a spring 226 to close the receipt dispensing port 26. A seventh photocoupler 230 is arranged at that portion of the fourth conveying passage portion 94e which is positioned on the rear side of the shutter 224. The shutter 224 is urged by a solenoid 228 to open the fourth conveying passage portion 94e at a timing when the receipt 36a causes the seventh photocoupler 230 to turn on.

A recovered receipt compartment 232 is disposed at the proximal end of the fourth conveying passage portion 94d to recover a receipt on which the transaction contents are printed. This receipt may be a receipt that need not be handed to the customer since the same transaction contents have been printed on his bankbook, or may be a receipt that the customer forgets to receive although it is once dispensed at the receipt dispensing port 26. In the former case, since the receipt 36a has not passed through the switch-back station 190, the printed surface faces down and stored in the compartment 232. However, in the latter case, since the receipt 36a has passed through the switch-back station 190, the printed surface faces up and is stored in the compartment 232.

As is apparent from the above description, the conveying passage 94 has the first to fifth conveying passage portions 94a to 94e. The second, fourth and fifth conveying passage portions 94b, 94d and 94e are for conveying especially the receipt 36a separated from the slip 36 in the second separating station 106. The third conveying passage portion 94c is for conveying especially the journal 36b separated from the slip 36 in the second separating station 106. The first conveying passage portion 94a is commonly used for conveying both the receipt 36a and the journal 36b except for the passage segment between the first separating station 100 and the printing station 104. The passage segment of the first conveying passage portion 94a is divided into a passage segment $94a_1$ for the receipt 36a and a passage segment $94a_2$ for the journal 36b. The cutting station 102 is disposed at the passage segment $94a_1$.

The setting operation of the string of slips 36 in the slip issuing device 30 with the above arrangement will be described with reference to FIGS. 12 to 16.

The operator takes out part of the string of slips 36 from the slip storage box 86, and mounts the receipt 36a which is the upper layer of the slip 36 onto the sprocket 88. The engaging hole 92 at each side of the leading end of the receipt 36a must be engaged with the corresponding reference engaging pin 90a of the sprocket 88. The operator sets the leading end of the separating pawl 110 of the first separating station 100 to overlap the leading end of the receipt 36a. In other words, the leading end of the receipt 36a is clamped between the outer surface of the sprocket 88 and the leading end of the separating pawl 110. The operator then mounts the journal 36b which is the lower layer of the slip 36 onto the sprocket 88. Similarly, the engaging hole 92 at each side of the leading end of the journal 36b must be engaged with the corresponding reference engaging pin 90a. Thus, the leading end of the receipt 36a is aligned with that of the journal 36b. The operator then moves the first guide 108 to cover the journal 36b. As a result, the receipt 36a and the journal 36b are separated by the separating pawl 110 and are firmly mounted on the sprocket 88.

When the operator presses a setting button (not shown), the slip 36 is automatically set in the slip issuing device 30 to be ready for issuing the slip.

Figure 12:
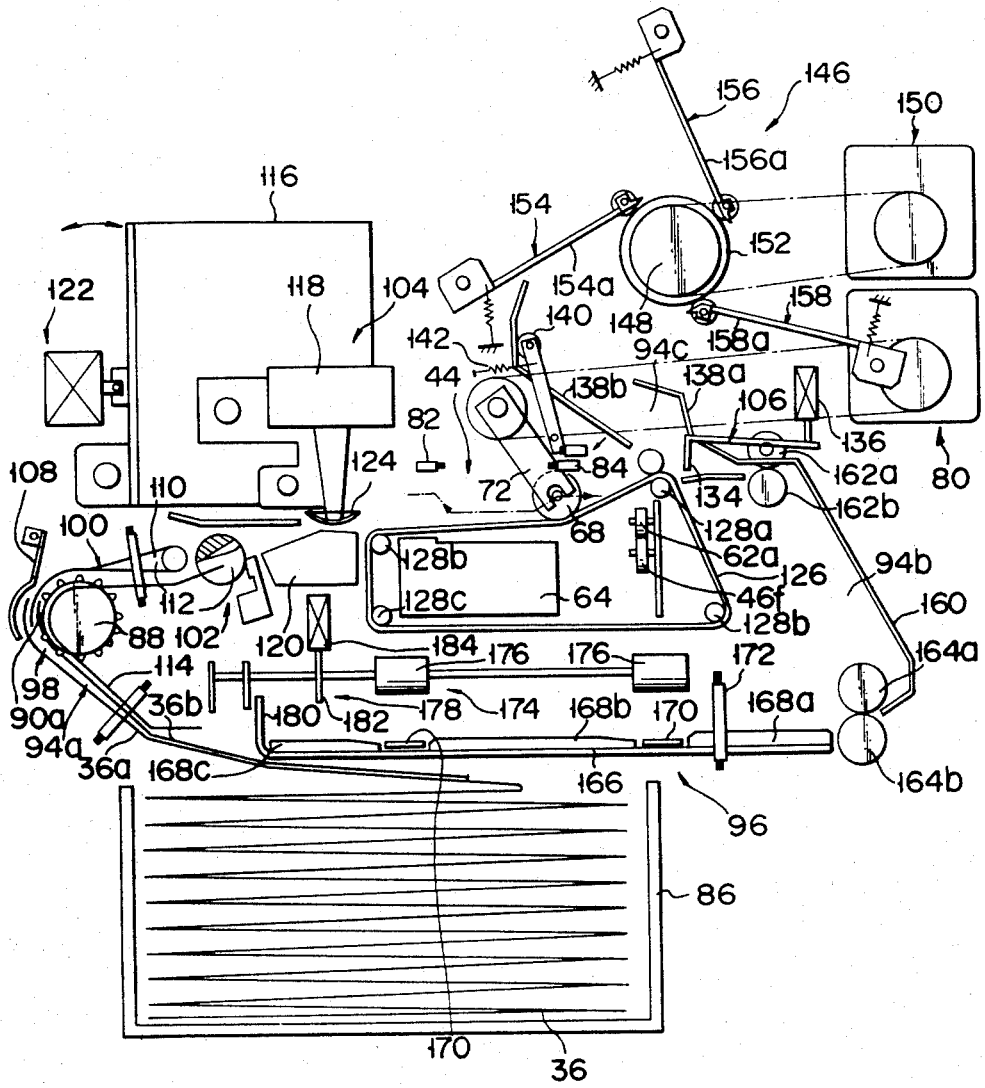
FIGS. 12 to 16 are front views sequentially showing the automatic setting operations of the string of slips.

When the operator presses the setting button in FIG. 12, the solenoid 122 is energized, and the main body 116 of the printing station 104 is pivoted so that the dot printer head 118 is separated from the anvil 120. Part of the first conveying passage portion 94a at the printing station 104 is widened. Thus, the slip 36 may not be jammed between the dot printer head 118 and the anvil 120. The solenoid 136 is also energized and the separating gate 136 of the second separating station 106 is moved to close the outlet port of the first conveying passage portion 94a. Subsequently, the third motor 150 is driven to rotate the take-up reel 148 in the clockwise direction at a predetermined speed, and the pair of fourth endless belts 126 are driven along the clockwise direction. Under the conditions described above, the sprocket 88 is rotated so that the slip 36 is conveyed alon the first conveying passage portion 94a.

The receipt 36a which constitutes the upper layer of the slip 36 when it is stored in the slip storage box 86 passes below the separating pawl 110 and is inserted into the cutting station 102. Meanwhile, the journal 36b which constitutes the lower layer of the slip 36 when it is stored in the slip storage box 86 passes above the separating pawl 110. The journal 36b thus passes above the cutting station 102. The timing sensor (not shown) detects that the leading end of the receipt 36a has reached the predetermined cutting position of the cutting station 102. However, the rotary cutter does not cut the receipt at a perforation until the slip 36 is automatically wound around the take-up reel 148.

Figure 13:
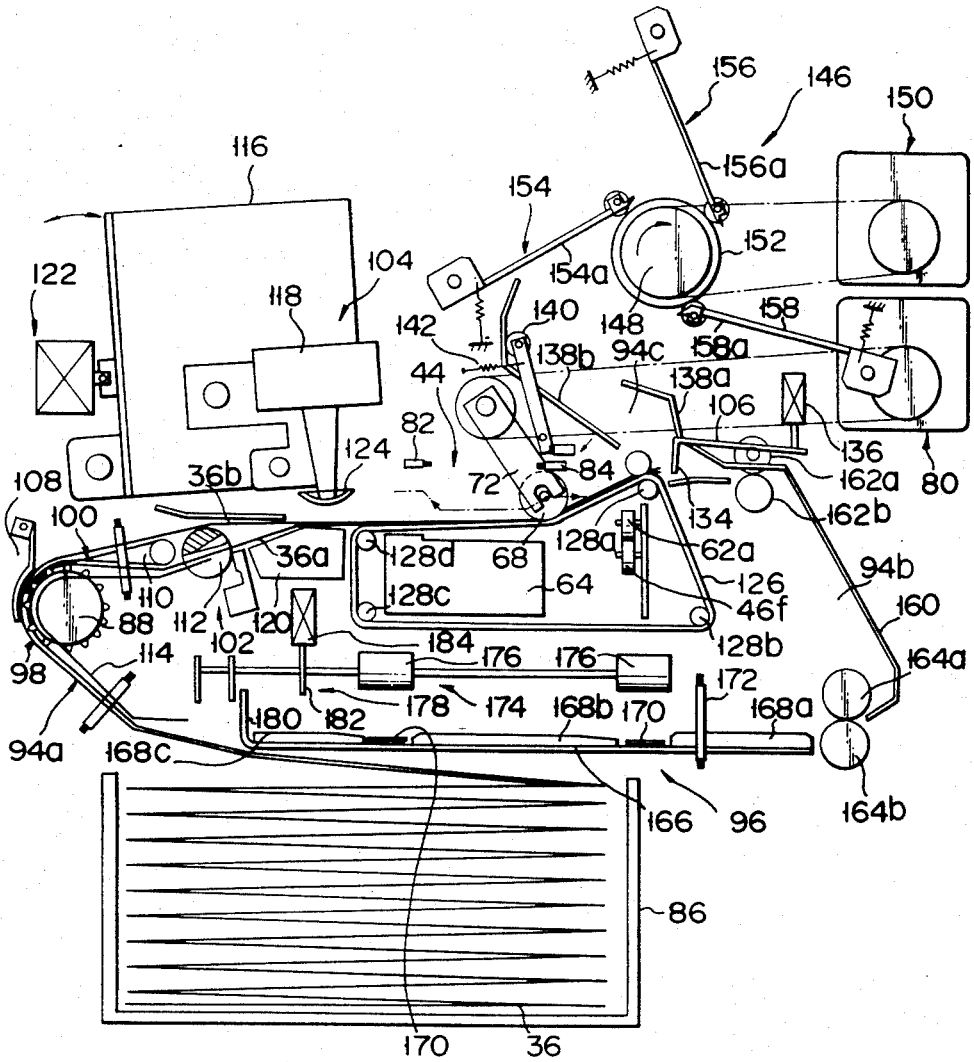

The receipt 36*a* and the journal 36*b* come together again in front of the printing station 104. They pass through the wide space between the anvil 120 and the dot printer head 118 of the printing station 104. They further pass between the transfer roller 68 and the pair of the fourth endless belts 126 and then between the first roller 128*a* and the pinch roller 132, as shown in FIG. 13. Thus, the transfer roller 68 functions as the pinch roller of the pair of fourth endless belts 126. Thereafter, the leading end of the slip 36 abuts against the separating gate 134 of the second separating station 106 and is then conveyed along the third conveying passage portion 94*c*.

Figure 14:
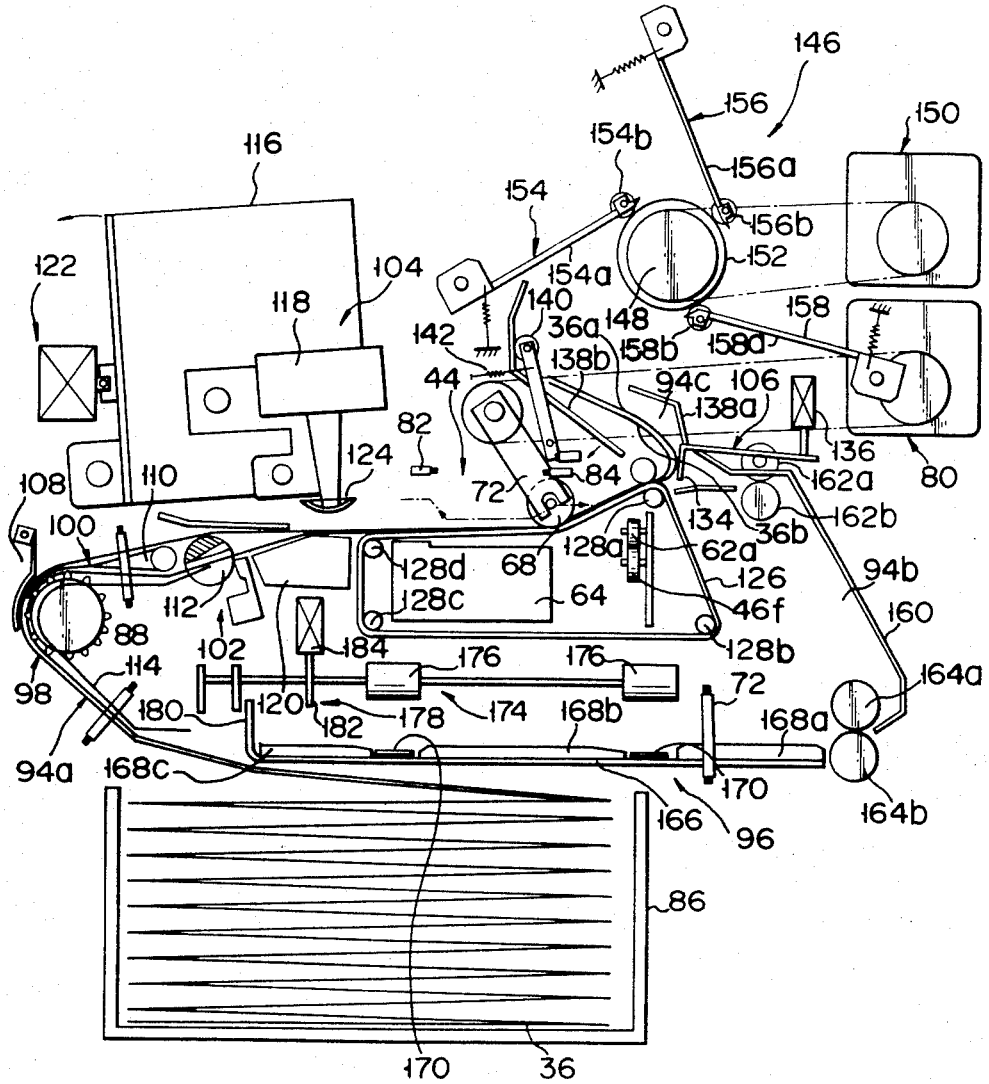
Figure 15:
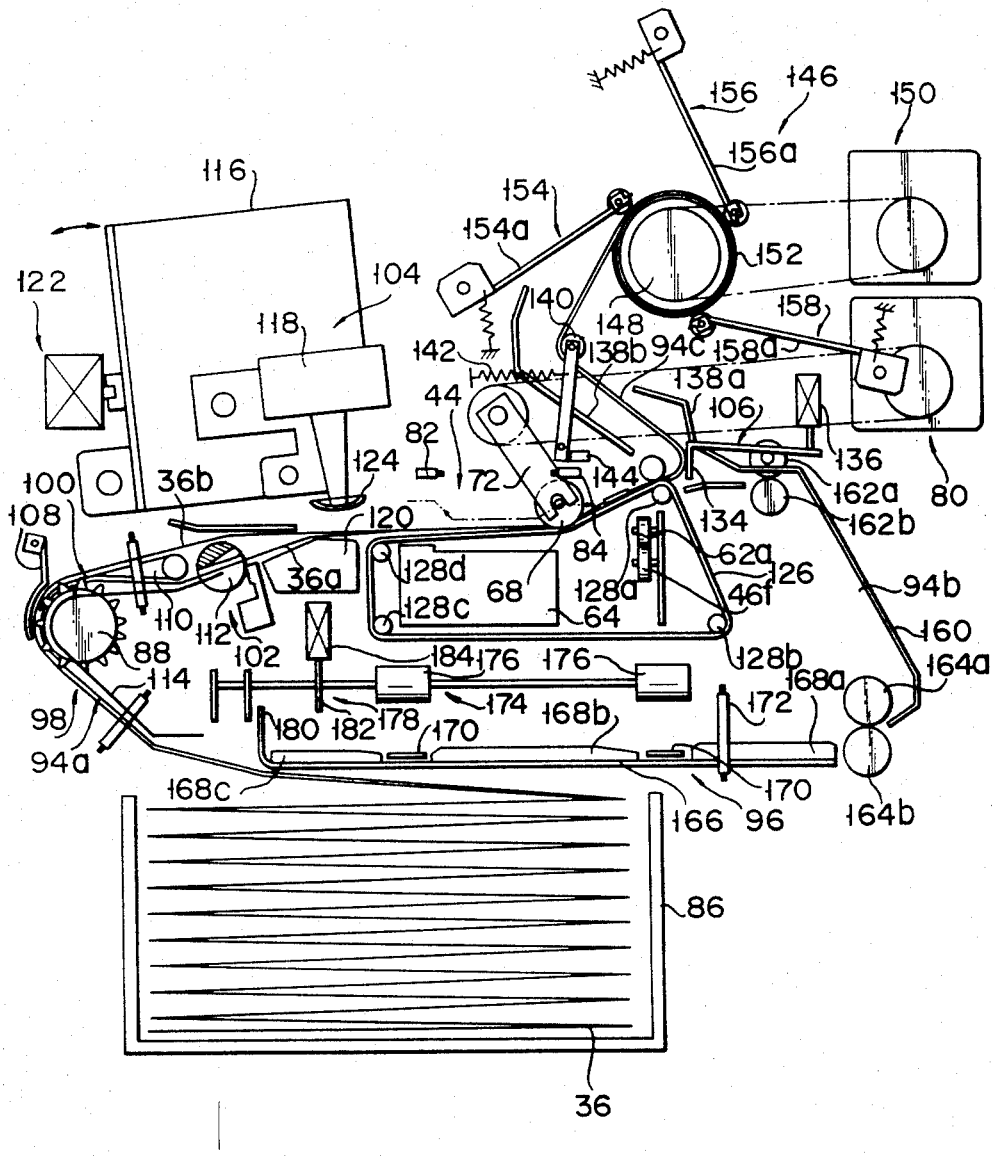

In the third conveying passage portion 94*c*, the slip 36 is restricted by the right guide wall 138*a* and is forced to be conveyed upward along the left guide wall 138*b* due to its stiffness. As shown in FIG. 14, the slip 36 passes between the left guide wall 138*b* and the dancer roller 140. Thereafter, the slip 36 reaches the take-up station 147 and is conveyed along the first arm 154*a* of the first press member 154 toward the take-up reel 148. Therefore, the slip 36 reaches a position between the friction band 152 and the first roller 154*b*. Then, the slip 36 is pulled toward the second press member 156 upon rotation of the take-up reel 148 in the clockwise direction. The leading end of the slip 36 abuts against the second arm 156*a* of the second press member 156 and passes between the friction band 152 and the second roller 156*b* therealong. The conveying direction of the slip 36 is then changed toward the third press member 156. Subsequently, the leading end of the slip 36 abuts against the third arm 158*a* of the third press member 158 and passes between the friction band 152 and the third roller 158*b* therealong. The conveying direction of the slip 36 is then changed toward the first press member 154. The leading end of the slip 36 abuts against that portion of another slip which has not reached a space between the first roller 154*b* and the friction band 152, and is wound between the latter slip and the friction band 152. As shown in FIG. 15, the two slips 36 overlap and are automatically wound around the friction band 152 in cooperation with three press members 154, 156 and 158. Note that the press members 154, 156 and 158 are radially outwardly displaced in accordance with winding of the slips 35.

The take-up reel 148 is continued to be driven by the third motor 150 and the widing operation of the slips 36 continues. Since the string of slips 36 is pulled as it is wound, the dancer roller 140 is rotated in the clockwise direction against the urging force of the spring 142. When the dancer roller 140 is further rotated from the predetermined position in the clockwise direction, the fourth photocoupler 144 is turned off and the driving of the third motor 150 is stopped. In this manner, overwinding of the slips 36 is prevented, and damage to the slips due to overwinding is prevented. Even after the third motor 150 is ceased rotating, the slip 36 is continued to be conveyed in accordance with running of the pair of fourth endless belts and rotation of the sprocket 88. As a result, the tension strength of the strip of slips 36 is weakened, and the dancer roller 140 is rotated in the counterclockwise direction by the urging force of the spring 142. Upon this rotation, the fourth photocoupler 144 is turned on and power is supplied to the third motor 150. Therefore, the strip of slips 36 are wound around the take-up reel 148 again. In this manner, since the third motor 150 is driven only by the on-state of the fourth photocoupler 144, stable winding can be performed.

Figure 16:
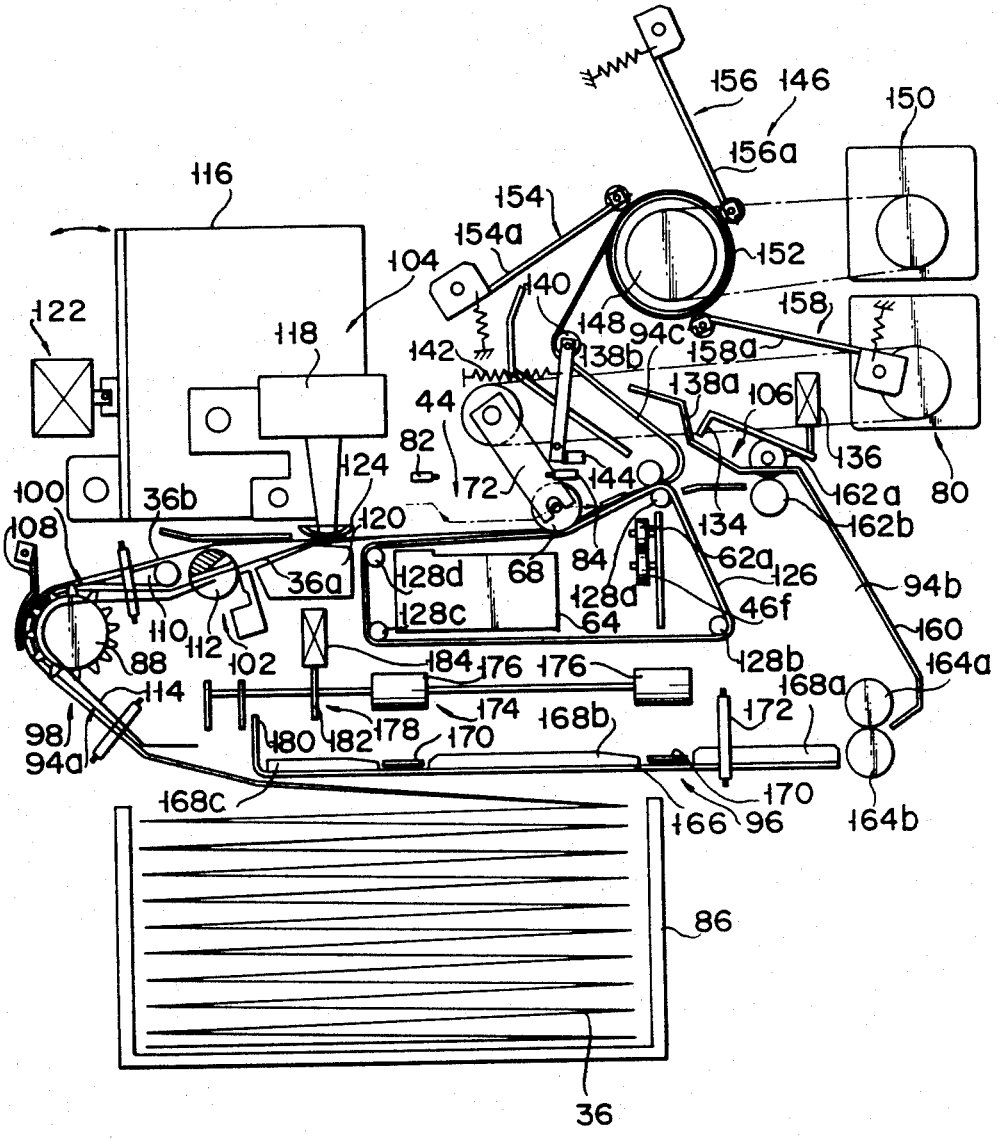

When the slip 36 is completely wound around the take-up reel 148, the cutting station 102 is ready for cutting and the solenoids 122 and 136 are de-energized. As shown in FIG. 16, the printing station 104 is set in the printing-ready state and the second separating station 106 is set in the separating-ready state. In this condition, the slip 36 is further conveyed upon rotation of the sprocket 88 and running of the pair of fourth endless belts 126. When the leading perforation of the receipt 36*a* for one transaction extends 5 mm from the nip portion between the first roller 128*a* and the pinch roller 132, the trailing perforation of the receipt 36*a* is brought into the cutting position of the cutting station 102 and is cut therein.

After cutting, the conveying operation is stopped when the slip 36 is conveyed by a distance of 85 mm from the cutting position. Thus, the slip setting is completed. Under this condition, since the cutting position is spaced apart from the printing position by a distance of 35 mm, the leading end of the receipt 36*a* is positioned 50 mm ahead of the printing position. The first printing position of the receipt 36*a* corresponds to the printing position when the setting of the slip is completed.

Thus, after the operator attaches the slip 36 on the sprocket 88, the slips 36 are automatically mounted in the slip issuing device 30 in the state that the slip is ready to be issued. The journal 36*b* can be wound around the take-up reel 148, while the first printing position of the receipt 36*a* opposes the printing position of the printing station 104. Thus, the printing operation can be immediately performed.

In the slip issuing device 30 in which the slips are automatically mounted as described above, the issuing operation of the slip will be described with reference to FIGS. 17 to 20.

A case will be essentially described in which the customer wishes to deposit or withdrawn money using his magnetic ID card.

If the customer inserts his magnetic ID card 34 through the magnetic ID card insertion port 24, it is conveyed to the embossing station 44 in accordance with aforementioned inserting operation for the card. Finally, the magnetic ID card 34 is firmly clamped between the rollers 46*f* and 62*a* and between the rollers 46*g* and 62*b*. Until the magnetic ID card 34 is conveyed to the embossing station 44, the second magnetic head 54 reads out customer information recorded on the magnetic stripe 34*b* of the magnetic ID card 34. The customer information together with transaction contents is printed on the slip 36 from the first printing position by the dot printer head 118 of the printing station 104. In one embodiment described above, printing contents are printed in seven lines. The slip 36 is conveyed only by a distance of 52 mm which corresponds to the space of the seven lines, upon rotation of the sprocket 88 and running of the pair of fourth endless belts 126. When printing is completed, the leading end of the slip 36 extends from the nip portion between the rollers 128*a* and 132 by 2 mm and the trailing end of the receipt 36*a* is spaced apart from the printing position by 38 mm.

Figure 17:
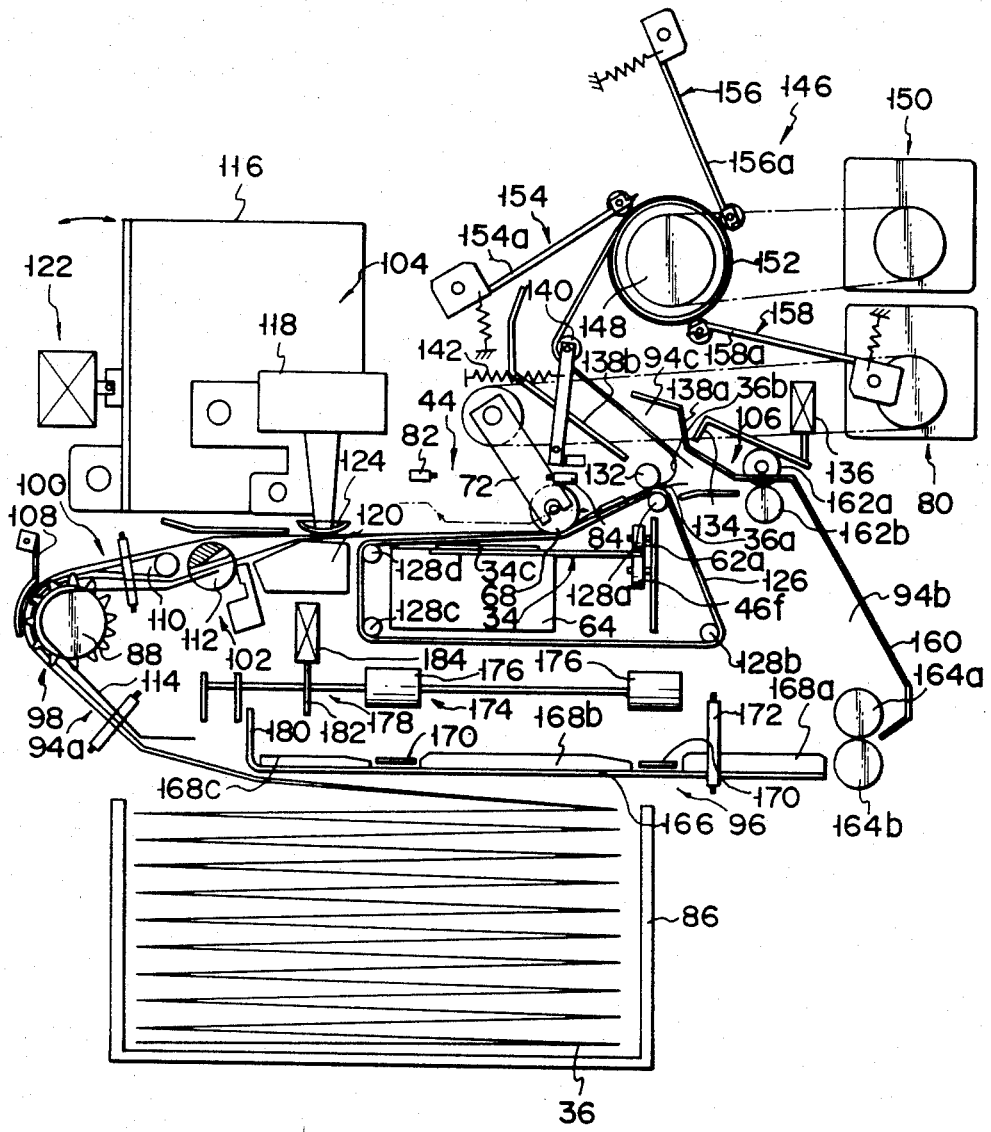
FIGS. 17 to 20 are front views sequentially showing the slip issuing operations.

The slip 36 is then moved by 3 mm to extend its leading end from the nip portion between the rollers 128*a* and 132 by 5 mm, as shown in FIG. 17. In this condition, the trailing end of the slip 36, that is, a perforation is brought into the cutting position of the cutting station 102. Simultaneously, the rotary cutter 112 initiates cutting to only cut the receipt 36a and thus the printed receipt 36a becomes a sheet for one transaction.

The slip 36 is then conveyed by 63 mm after cutting. Another slip in front of the printed slip 36 is connected to the take-up reel 148 and is wound therearound. Since the journal 36b of the printed slip 36 is not cut, it is continuously wound around the take-up reel 148. However, since the receipt 36a of the printed slip 36 is cut, it travels straight due to its stiffness along the second conveying passage portion 94b and is clamped between the rollers 162a and 162b. Thus, the leading end of the journal 36b is positioned on the third conveying passage portion 94c and can be wound in the take-up station 146, while the leading end of the receipt 36a is separated from the journal 36b and is positioned in the second conveying passage portion 94b.

Figure 18:
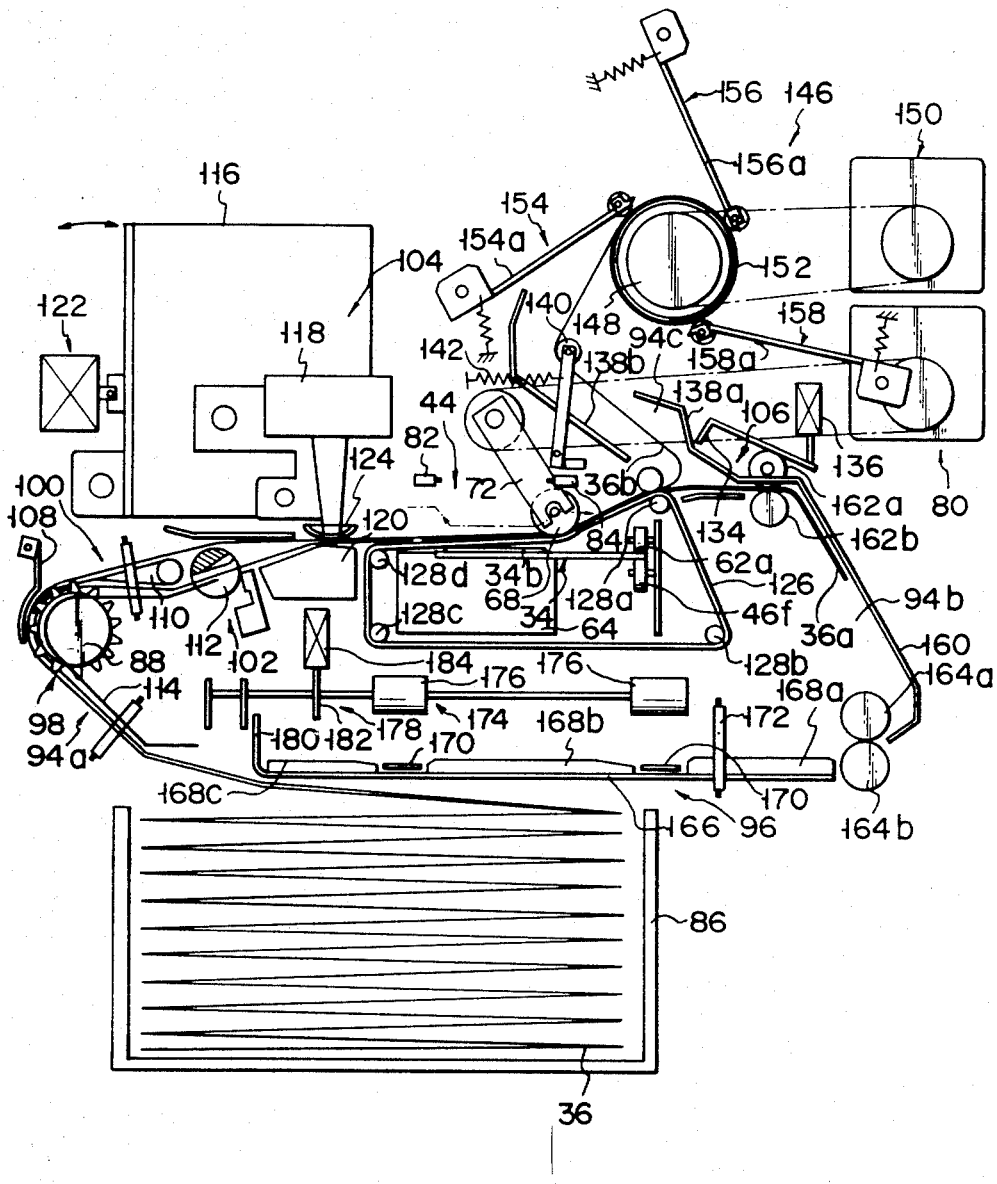
Figure 19:
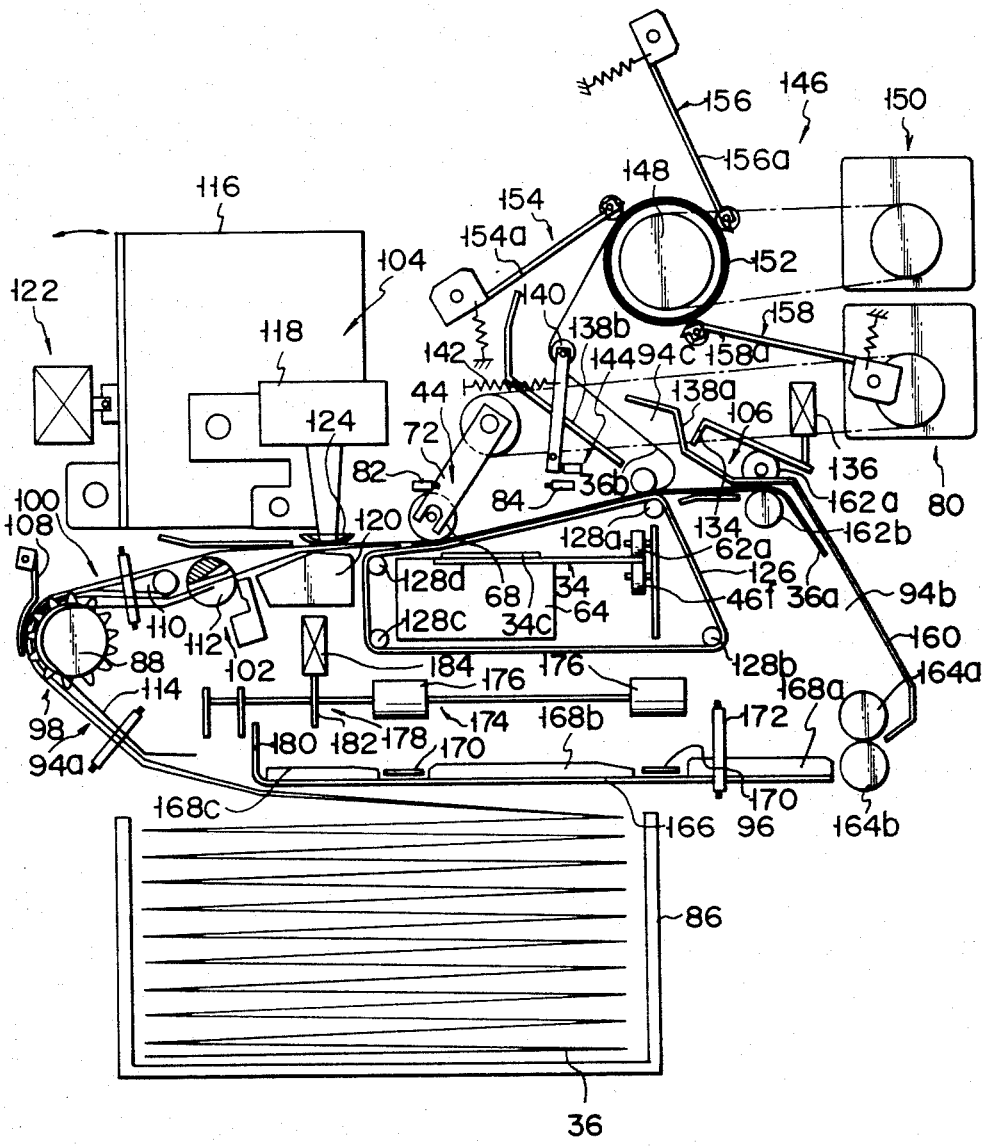

The printed slip 36 upon travelling the distance of 63 mm is brought into a transferable state in the embossing station 44, as shown in FIG. 18. Note that the printed slip 36 is indicated by a thick line. The subsequent slips, of course, follow the printed slip 36. In this condition, the support arm 72 is rotated from the second waiting position to the first waiting position in the clockwise direction, upon rotation of the second motor 80, as shown in FIG. 19. The transfer roller 68 transfers information embossed on the embossed portion by tightly contacting the embossed portion 34c of the magnetic ID card 34 onto the corresponding portion of the slip 36. Note that the printed surface of the receipt 36a faces up.

Figure 20:
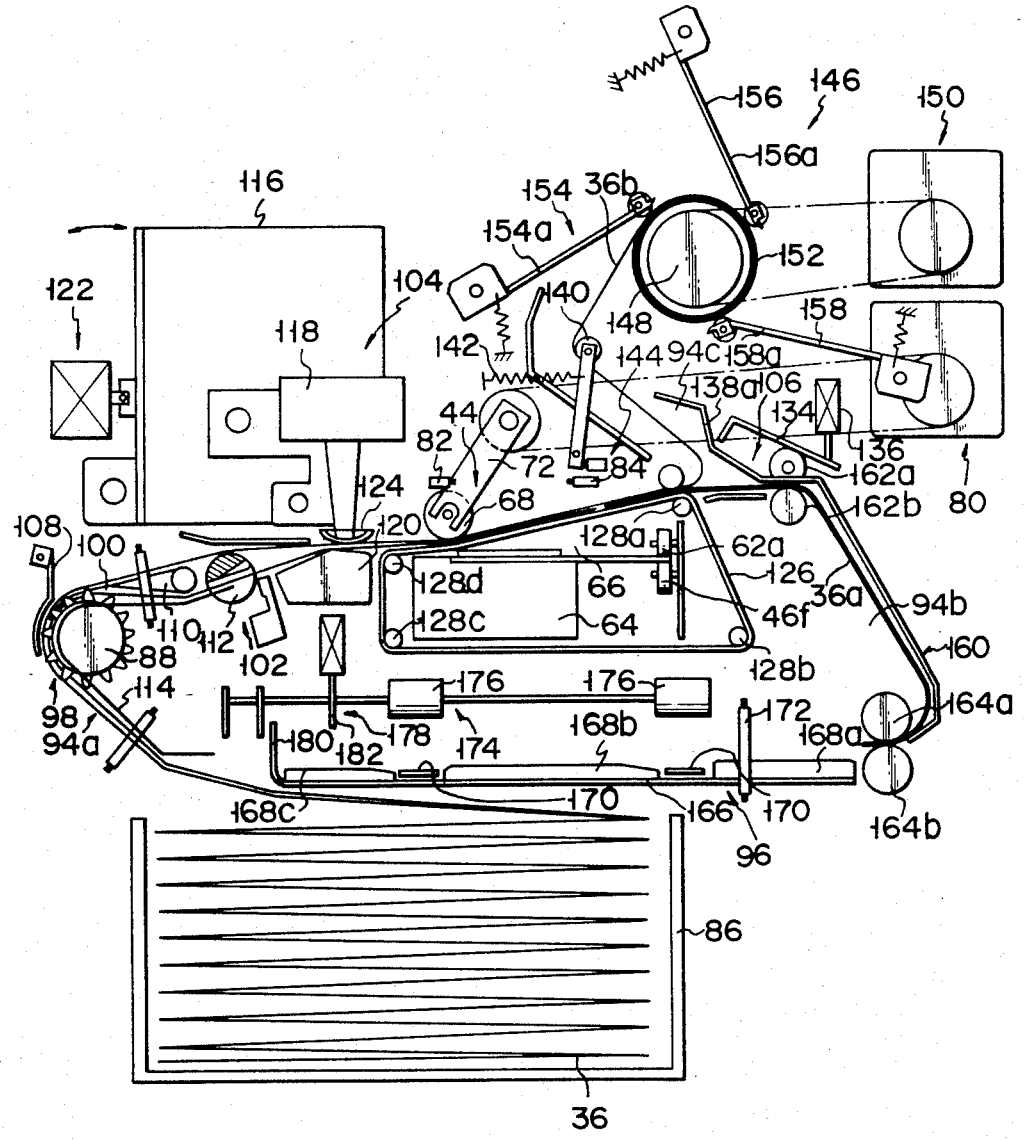
Figure 21:
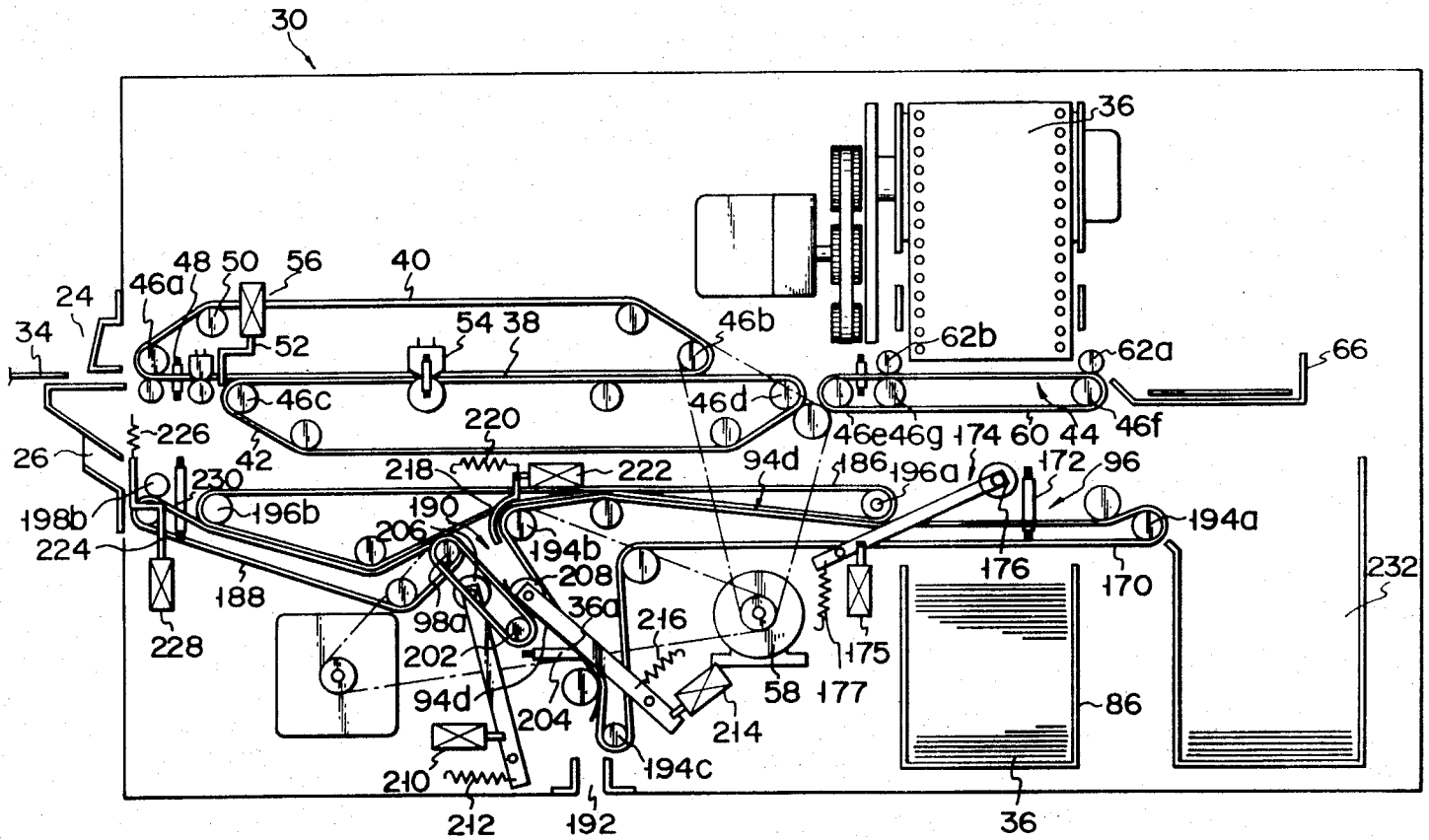
FIG. 21 is a side view showing the position of the slip in a switch-back station.

After the transfer operation, the slip 36 is further moved by 22 mm. The leading end of the receipt 36a is clamped by the another rollers 164a and 164b, as shown in FIG. 20. The trailing end of the slip 36 after transfer or the leading end of the next slip 36 is 85 mm ahead of the cutting position. In other words, the slip is set in the printing-ready state.

In this condition, the sprocket 88 and the pair of fourth belts 126 are fixed, while only the another drive roller 162a is fast driven, so that only the receipt 36a is conveyed into the direction converting station 96 so as to be flying in the air. Since the sprocket 88 and the pair of fourth belts 126 are not driven, the journal 36b corresponding to the receipt 36a described above and the subsequent slips 36 remain unmoved. The drive roller 162a is driven at high speed. Therefore, the receipt 36a facing down jumps to the direction converting station 96. The guide tables 168a, 168b and 168c in the direction converting station 96 are sequentially lowered and do not interfere with the conveying operation of the receipt 36a.

For providing the receipt 36a to the customer together with the magnetic ID card, the solenoid 184 is de-energized and the movable stopper 182 does not close the second conveying passage portion 94b. Therefore, against stationary stopper 180 abuts the receipt 36a and the receipt 36 is defined its stopping position in the direction converting station 96 by the stationary stopper 180. The receipt 36a is thus placed on the three guide tables 168a, 168b and 168c. The center of the receipt 36a is aligned with that of the magnetic ID card 34. However, for providing the receipt 36a to the customer together with the bank notes, the solenoid 184 is energized and the movable stopper 182 closes the second conveying passage portion 94b. The receipt 36a abuts against the movable stopper 182 and is stopped thereby. The receipt 36a is thus placed on the three guide tables 168a, 168b and 168c. In this position, the center of the receipt 36a is aligned with that of the bank notes.

The receipt 36a conveyed to the direction converting station 96 is urged onto the pair of fifth belts 170 when the press rollers 176 descend upon energization of the solenoid 175. The receipt 36a is thus conveyed to the switch-back station 190 along the fourth conveying passage portion 94d in accordance with running of the pair of fifth endless belts 170 in the counterclockwise direction in FIG. 4. Note that the receipt 36a need not be provided to the customer if he deposites or withdraws money with his bankbook. Therefore, the pair of fifth belts 170 are driven in the clockwise direction. The receipt 36a is recovered in the recovered receipt compartment 232 wherein the printed surface of the receipt 36a remains to face down.

The receipt 36a conveyed to the fourth conveying passage portion 94d abuts against the gate 218 and is regulated to be temporarily conveyed in the fifth conveying passage portion 94e. Thereafter, conveying of the receipt 36a in the fifth conveying passage portion 94e is stopped when the receipt 36a crosses the photocoupler 204. In this condition, the receipt 36a is clamped between the pair of fifth belts 170 and the pair of first pinch rollers 206, respectively. For providing the receipt 36a to the customer together with the bank note, the receipt 36a is fed to the bank note dispensing mechanism 32 through the communicating port 192. A detailed description of the bank note dispensing mechanism 32 is omitted. However, the center of the bank note is aligned with that of the receipt 36a, and the receipt 36a together with the bank note is dispensed at the bank note dispensing port 28 to the customer.

However, for dispensing the receipt 36a at the receipt dispensing port 26, the solenoids 210 and 214 are energized in the switch-back station 190. Thus, the receipt 36a is clamped between the eighth endless belt 200 and the second pinch roller 208. Then, the eighth endless belt 200 is driven in the counterclockwise direction and the receipt 36a is taken out from the switch-back station 190. The receipt 36a thus turned over is conveyed on the fourth conveying passage portion 94d toward the receipt dispensing port 26. When the receipt 36a passes by the seventh photocoupler 230, which is then turned on, the solenoid 228 is energized and the shutter 224 is opened. As a result, the receipt 36a is dispensed at the receipt dispensing port 26.

If the customer forgets to take the receipt 36a dispensed at the receipt dispensing port 26 and a predetermined period of time elapses, a timer mechanism (not shown) is operated to feed back the receipt 36a through the fourth conveying passage portion 94d and toward the recovered receipt compartment 232. In this condition, the solenoid 222 is energized and the gate 218 is moved to open the fourth conveying passage portion 94d. Thus, feeding of the receipt 36a toward the recovered receipt compartment 232 may not be interrupted.

The receipt 36a thus forgotten by the customer is stored in the recovered receipt compartment 232 with its printed surface facing up. As described above, the receipt 36a that need not be provided to the customer since the transaction is made with the bankbook is stored with its printed surface facing down. Therefore, the receipt 36a that need not be provided to the customer is clearly distinguished from the receipt 36a that the customer forgets to take. Therefore, when the operator takes out receipts facing up in the recovered receipt compartment 232 and counts the number of these receipts, he can immediately know the number of receipts that the customers have forgotten to take.

What is claimed is:

1. A slip issuing device which has a string of slips separable from each other and each having a receipt and a journal, which records customer information and a transaction content thereon, which stores a string of journals therein, and provides a single receipt to a customer, comprising:

a housing having, a receipt dispensing port through which the receipt is dispensed;

storing means disposed in said housing, for storing the string of slips which can be taken out;

guiding means engageable with the string of slips taken out from said storing means, for allowing the string of slips to travel along a conveying direction on a first conveying passage;

first separating means disposed adjacent to said guiding means along the conveying direction, for temporarily separating the string of slips into the string of receipts and the string of journals;

printing means disposed adjacent to said first separating means along the conveying direction, for allowing the strings of receipts and journals which are separated by said first separating means to come together and for printing predetermined transaction content thereon;

cutting means disposed between said printing means and said first separating means, for cutting the single receipt for one transaction from the string of receipts separated from the string of journals; and second separating means disposed adjacent to said printing means along the conveying direction, for separating the string of slips into the string of receipts to be conveyed in a second conveying passage and the string of journals in a third conveying passage when issuing the single receipt and for allowing the strings of receipts and journals to come together and travel on said third conveying passage when setting the string of slips.

2. The device according to claim 1, wherein the slip has a plurality of holes aligned at least at one side thereof along the conveying direction at equal intervals; and said guiding means includes:

a sprocket rotatably disposed and having pins engageable with said plurality of holes on part of an outer surface thereof, the string of slips being conveyed along the conveying direction by engagement of said pins with said plurality of holes upon the rotation of the sprocket; and a guide member disposed adjacent to the outer outer surface of said sprocket, for maintaining the engagement of the slip with said sprocket by clamping the slip in cooperation with the outer surface of said sprocket.

3. The device according to claim 2, wherein said first separating means includes a separating pawl which has a flexible distal end which can abut against the outer surface of said sprocket, said distal end of separating pawl being interposed between the strings of receipts and journals when the string of slips is set.

4. The device according to claim 1, wherein said printing means includes:

a movable main body;

a printing head mounted on said main body;

an anvil opposing said printing head through said first conveying passage; and driving means for driving said main body to a position where said printing head is spaced apart from said anvil when the string of slips is set and to a position where said printing head comes close to said anvil through the string of slips therebetween when the receipt is issued.

5. The device according to claim 4, wherein said printing head has a press plate at a distal end thereof, said press plate functioning as a guide for a leading end of the string of slips when the string of slips is set and functioning as a press body for pressing the slip to be printed when the receipt is issued.

6. The device according to claim 5, wherein said press plate comprises an elastic body and elastically urges the slip toward said anvil when the single receipt is issued.

7. The device according to claim 1, which provides the single receipt to the customer when the customer withdraws/deposits a bank note with a magnetic ID card having an embossed portion with a customer information, and dose, not provide the single receipt to the customer when the customer withdraws/deposits the bank note with a bankbook; and wherein the housing has a magnet ID card inserting/-dispensing port through which the magnet ID card is inserted/dispensed, and a bank not dispensing port through which the bank not is dispensed.

8. The device according to claim 7, which further comprises transferring means disposed between the printing means and the second separating means, for transferring the customer information of the embossed portion onto the slip.

9. An apparatus according to claim 8, further comprising a magnetic ID card conveying passage, one end of which is connected to said magnetic ID card inserting/dispensing port and the other end of which extends to said transferring means to convey the magnetic ID card inserted through said magnetic ID card inserting-/disponsing port to said transferring means, and wherein the slip comprises carbonless duplicating paper, and said transferring means includes:

a pair of conveyer belts defining part of the first conveying passage which conveys the slip, said pair of conveyer belts supporting both sides of the slip along the conveying direction and positioning above two sides of the embossed portion of the magnetic ID card at said transferring means, respectively;

a transfer roller movable disposed and constantly engageable with upper surfaces of said pair of conveyer belts, for pressing the slip onto the embossed portion conveyed at the transferring means to transfer the customer information to the slip.

10. The device according to claim 9, wherein the embossed portion of the magnetic ID card has a predetermined height, and a thickness of each of said conveyer belts has a height greater than the predetermined height of the embossed portion.

11. The device according to claim 1, further comprising take-up means, disposed at the distal end of said third conveying passage, for winding the strings of the receipts and journal conveyed thereto when setting the string of slips and for winding the string of journals conveyed thereto when issuing the single receipt.

12. The device according to claim 11, wherein said take-up means includes: a take-up reel which has an outer surface engaged with a leading end of the string of slips conveyed thereto; and pressing means for pressing the slips toward said take-up reel.

13. The device according to claim 12, wherein said pressing means has three rollers which can abut against the outer surface of said take-up reel and urging members for urging said three rollers to abut against the outer surface of said take-up reel, respectively, said three rollers being spaced apart from the outer surface of said take-up reel against the urging forces of said urging members in accordance with a winding amount of the slips wound around said take-up reel.

14. The device according to claim 13, wherein said three rollers are disposed around the outer surface of said take-up reel at equal intervals.

15. The device according to claim 14, wherein said three rollers are made of a material with a predetermined coefficient of friction, said take up means includes a band having higher coefficient of friction than the predetermined coefficient of friction and adhered to the outer surface of said take-up reel.

16. The device according to claim 1, further comprising direction converting means disposed at the distal end of said second conveying passage, for changing the conveying direction of the single receipt conveyed thereto to a direction substantially perpendicular thereto.

17. The device according to claim 16, wherein said second conveying passage has a drive roller and a pinch roller to clamp the single receipt cut for one transaction and conveyed from said first conveying passage therebetween and to convey the single receipt to said direction converting means, said drive roller being driven in a condition that conveying in said first conveying passage is stopped, whereby only the single receipt is taken out from said first conveying passage.

18. The device according to claim 17, wherein said direction converting means includes:

a fourth conveying passage for conveying the single receipt in a direction substantially perpendicular to said second conveying passage, said fourth conveying passage having a pair of endless belts;

three rests arranged at equal intervals on which the single receipt is placed, said pair of endless belts each being positioned between two adjacent rests among said three rests; and pressing means for pressing the single receipt placed on said three rests onto the pair of endless belts.

19. The device according to claim 18, wherein said three rests are sequentially lowered in height along the conveying direction of said second conveying passage.

20. The device according to claim 17, wherein a distal end of said fourth conveying passage is connected to said receipt dispensing port.

21. The device according to claim 20, further comprising:

a fifth conveying passage branched from said fourth conveying passage;

switch-back means disposed at a distal end of said fifth conveying passage; and a bank note dispensing mechanism having a connecting portion connected to said switch-back means, for dispensing predetermined bank notes at said bank note dispensing port, said switch-back means allowing the single receipt to be fed back to said fourth conveying passage by driving said fifth conveying passage in a reverse direction for dispensing the single receipt at said receipt dispensing port, and said switch-back means allowing the single receipt to be fed to said bank note dispensing mechanism through said connecting portion for dispensing the single receipt together with the predetermined bank notes.

22. The device according to claim 21, further comprising a recovered receipt compartment disposed at the proximal end of said fourth conveying passage, for recovering the single receipt in said fourth conveying passage by driving said fourth conveying passage in the reverse direction.

23. The device according to claim 21, wherein said magnetic ID card inserting/dispensing port has a center which is vertically aligned with a center of said receipt dispensing port; and said direction converting means has position regulating means for regulating a stop position of the single receipt placed on said three rests, said position regulating means including:

a stationary stopper fixed at said direction converting means, for aligning a center of the single receipt abutting thereagainst with the center of said receipt dispensing port;

a movable stopper capable of closing said second conveying passage, for aligning the center of the single receipt with the center of said bank note dispensing port when said movable stopper closes said second conveying passage; and driving means for driving said movable stopper between a position where said second conveying passage is closed and a position where said second conveying passage is opened, whereby the single receipt abuts against said stationary stopper when the movable stopper opens said second conveying passage.

* * * * *